United States Patent [19]

Russell et al.

[11] 4,123,890

[45] Nov. 7, 1978

[54] ENVELOPE OPENING APPARATUS AND METHOD

[76] Inventors: Robert J. Russell, 4300 Potter St., Philadelphia, Pa. 19124; William Young, 407 N. Clinton Ave., Wenonah, Gloucester County, N.J. 08090; Barry D. Nuss, 893 Marian Rd., Woodbury, Gloucester County, N.J. 08096

[21] Appl. No.: 755,577

[22] Filed: Dec. 29, 1976

Related U.S. Application Data

[60] Continuation of Ser. No. 486,077, Jul. 5, 1974, abandoned, which is a division of Ser. No. 289,314, Sep. 15, 1972, Pat. No. 3,822,523.

[51] Int. Cl.[2] ..... B65B 43/26

[52] U.S. Cl. ..... 53/396; 53/381 R; 83/912

[58] Field of Search ..... 53/3, 381 R; 225/2, 225/3, 5; 83/912

[56] References Cited

U.S. PATENT DOCUMENTS

| | | | |
|---|---|---|---|
| 3,060,075 | 10/1962 | Kincaid | 53/381 R X |
| 3,286,926 | 3/1966 | Hock | 83/912 X |
| 3,691,726 | 9/1972 | Stephens | 53/381 R |
| 3,726,454 | 4/1973 | Robbins | 53/381 R X |
| 3,764,049 | 10/1973 | Russell et al. | 83/912 |

*Primary Examiner*—John Sipos

*Attorney, Agent, or Firm*—Weiser, Stapler & Spivak

[57] ABSTRACT

Apparatus and method for opening an envelope upon three sides. The apparatus employs a circular rotating wheel which supports a plurality of complementary pairs of paddles which are designed to open at predetermined times to receive an envelope and close upon the envelope in a protective manner. The envelope is first received in the paddles with the leading edge thereof slightly exposed. As the paddles progress in their circular motion, the leading edge is engaged by means which weaken the edge. Thereafter, the paddles are opened and a conveyor below the paddles repositions the envelope between the paddles so as the trailing and bottom edges thereof are slightly exposed. As the paddles progress, the trailing and bottom edges are likewise weakened after which the envelope is discharged to an opening means.

Opening means are provided which receive the envelope and convey the envelope by means of a belt over idler pulleys which cause parallel shearing forces to the sides of the envelope by reverse flexing of the envelope to crack the weakened edges. The envelope is then passed between a belt and a roller through which a vacuum is induced to grip the opposite panels of the envelope and exert a separating force perpendicular to the panels to complete opening of the envelope and expose the contents thereof.

14 Claims, 30 Drawing Figures

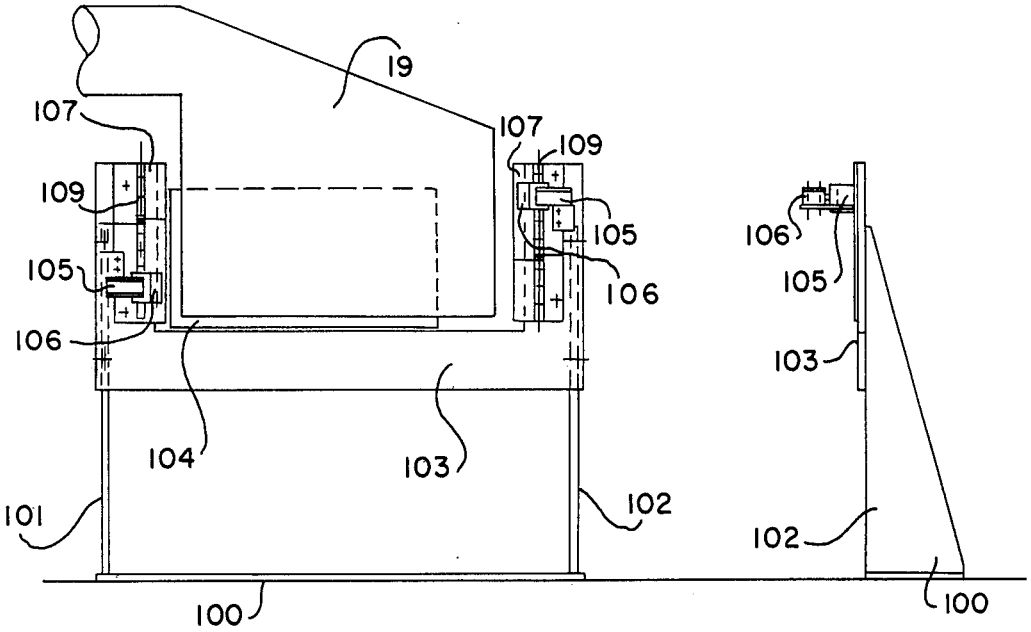
FIG. 12 A
FIG. 12 B
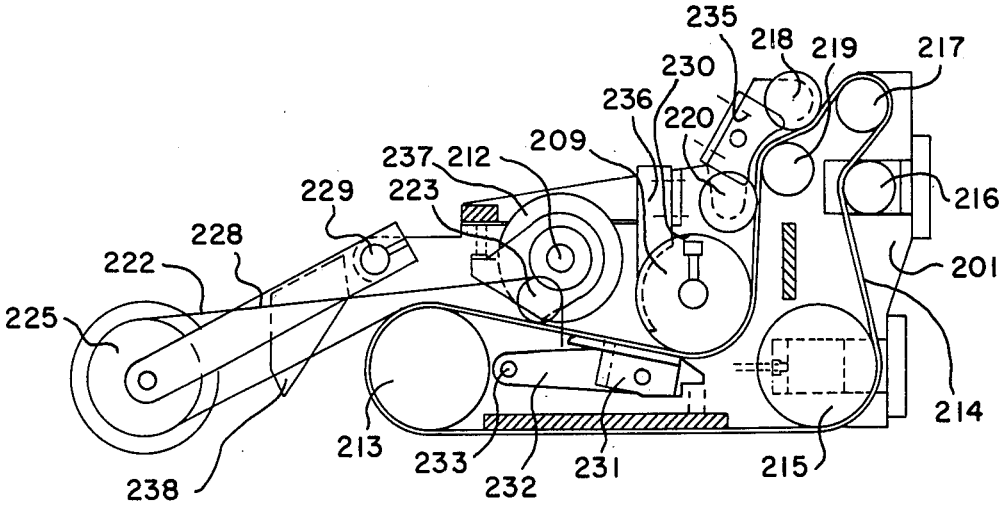
FIG. 26

FIG. 13
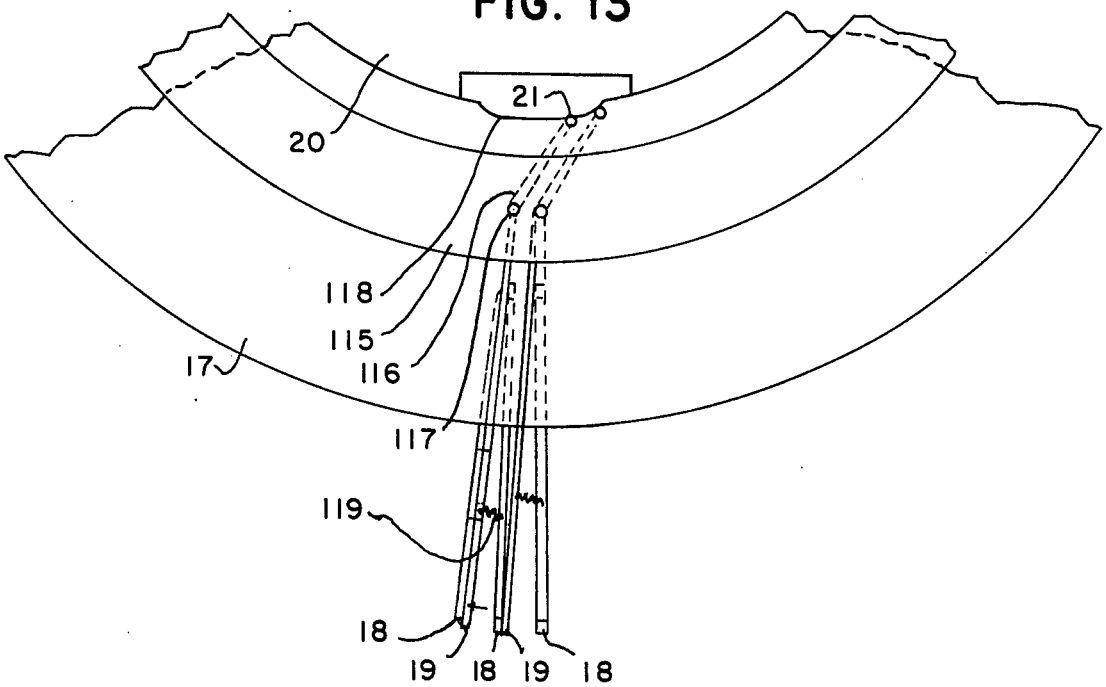
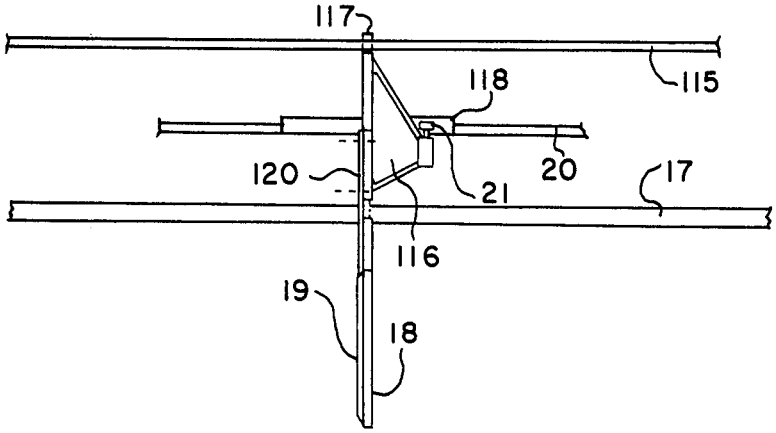
FIG. 14

ENVELOPE OPENING APPARATUS AND METHOD

This application is a continuation of application Ser. No. 486,077 filed July 5, 1974, now abandoned, which was a division of application Ser. No. 289,314, filed Sept. 15, 1972 now U.S. Pat. No. 3,822,523.

BACKGROUND OF INVENTION

The present invention applies to apparatus and method for opening envelopes and, more particularly, to improved method and apparatus for handling an envelope to effect opening thereof on three sides.

The volume of mail being handled in the United States is increasing every year at an alarming rate. Many companies, such are credit card companies and oil companies, receive literally thousands of pieces of mail daily. Such companies employ large numbers of people in departments whose only function is to simply open the envelopes and dispatch the contents thereof to the proper departments.

Where companies receive extremely large amounts of mail on a daily basis, even a delay of one day in opening the mail can create very serious problems and be quite costly as well. For example, where financial institutions such as credit card companies and utility companies are involved, a delay in processing the mail thus resulting in a one day's delay in depositing the checks can result in a very substantial loss of interest on such an amount even for one day. Accordingly, the need for a quick and efficient mail opening machine in such instances has become paramount.

Over the past few years, various attempts have been made to design and develop equipment which will mechanically open the mail. Until now, all of these devices have been of a type which essentially open one edge of the envelope. This is accomplished by such means as slitters, abraders, or cutters which engage one side of the envelope.

Onesided envelope openers have not been altogether satisfactory. The primary problem of onesided envelope openers is that the contents are still within the envelope at the time they reach the sorting personnel. Accordingly, the sorting personnel must still expend the time of expanding the panels of the envelope and removing the contents from the envelope. This represents but small saving of time over having the same personnel actually open the one side of the envelope themselves. Additionally, the onesided envelope openers do not dispose of the problem of unobserved contents remaining in the envelope which are not removed. Accordingly, candleing devices and the like are often necessary to insure that all of the contents have been removed.

The desirable form of envelope opener is one which will open the envelope on three sides and lay back both panels of the envelope completely and fully exposing the entire contents of the envelope. An envelope opened in this manner requires the operator only to merely pick up the contents rather than have to fumble with the envelope opened on one side to remove the contents. Additionally, the chances of missed contents become nil when an envelope is opened in this manner.

The problems encountered in the design and operation of a practical three sided envelope opener are significantly greater than that involving the opening of only one side. Three such major problems encountered are firstly, the method of opening or treating the edges of the envelope, secondly, the method and apparatus for handling the envelope by which three edges thereof can be exposed for opening and, thirdly, the manner in which the panels of the envelope themselves are laid back to expose the contents.

As regards the method of opening employed in a three sided opener, a design consideration must be made as to whether or not the three edges will be completely severed and opened initially or merely weakened and opened simultaneously at a final point in the operation. It has been found, in most instances, it is preferable to only weaken the edges of the envelope rather than completely sever and open them during the initial stages. In this manner, loose contents such as coins and credit cards will be retained within the confines of the envelope even though weakened until the final opening operation.

One method which has been found very satisfactory for weakening the edges of the envelope without completely opening them in the preliminary stages is the application of heat to the edges by convection or radiation. Such methods and apparatus for accomplishing this are disclosed in U.S. Pat. No. 3,590,548 and in U.S. application Ser. No. 74,060 filed Sept. 21, 1970 now U.S. Pat. No. 3,875,722.

As more fully explained in the aforementioned U.S. Patent and application, the application of heat to the edges of the envelope tends to dry out the fibers in the immediate vicinity of the edge in a process known as carbonization thus weakening the edges permitting their easy serverance by the application of forces at a later stage. This method is one of the methods employed in the envelope opening apparatus of the present invention. However, other methods of weakening the edges may also be employed as hereinafter described.

The method and apparatus for handling the envelope to treat three sides thereof also presents many problems. One consideration is whether or not to simultaneously treat all three sides of the envelope. Since envelopes are of varying sizes, simultaneous treatment becomes an extremely difficult problem unless a machine is designed to handle only a given size of envelope.

It has been found that, from a practical standpoint, the sides of the envelope must be treated in separate stages. This means that the envelope must be reorientated to a proper position for opening of the respective sides. The reorientation of the envelope presents many problems of handling. Apparatus has been proposed whereby the envelope is rotated from one edge to its second edge and then to a third edge to sequentially present the edges for treatment. However, this apparatus is extremely complex, cumbersome and slow in operation. Various other methods have been tried such as ones involving devices which must reciprocate in their handling of the envelope. Such devices are inherently slow and as such become unsatisfactory.

Lastly, the apparatus which actually effects the separation of the panels themselves involves many design difficulties. One such problem is the presence of stiff members such as coins or cards in the envelope. The opening apparatus must be capable of standing passage of such elements through the machine and also handling such elements without scattering them upon opening them. Such devices as brakes which will shear back one of the panels of the envelope have been proposed. These devices will operate satisfactorily, however, the timing and roller pressures become critical and varying envelope thicknesses may become a problem in their operation.

OBJECTS AND SUMMARY OF INVENTION

It is an object of the present invention to provide apparatus and methods of handling an envelope to present three sides thereof for treatment which can operate at a high speed, will protect the contents of the envelope and also accurately position each of the sides for engagement with the edge treating means.

It is a further object of the present invention to provide apparatus and methods for opening envelopes which have three sides thereof weakened and which is insensitive to hard objects within the envelopes and varying thickness thereof.

The present invention carries out the foregoing object in respect to handling of the envelope by providing an apparatus and method in which positive control of the envelope is never lost. This is accomplished by means of a wheel upon which a plurality of complementary pairs of stationary and moveable, protective paddles are arranged in a circular array. The paddles are designed to open at a feeding station at which an envelope is fed between the stationary and moveable paddles. A stop bar adjacent the paddle positions the leading edge of the envelope slightly exposed from the protective paddles. As the wheel advances in a circular direction, the paddles close in a protective gripping relationship on the envelope and the envelope is transported past a treating station at which the leading and exposed edge of the envelope is weakened.

The envelope then next proceeds with the rotation of the wheel to a transfer station. At this point, the moveable paddle is opened and the envelope is released. Disposed immediately below the paddles at the transfer station is a conveyor moving in a radially outward direction. The envelope, on being released, engages the conveyor and is conveyed against a radially outwardly positioned stop bar. Both the stop bar and the elevation of the conveyor are such that, as the moveable paddles closes upon further rotation of the envelope, the bottom and outer edge of the envelope will be slightly exposed from the paddles surrounding and gripping the envelope. The envelope is then conveyed passed treating means which weaken both the exposed outer edge and bottom edge of the envelope.

The foregoing object in respect to opening of the envelope is carried out in the present invention by means of apparatus which will first induce a shearing force parallel to the panels of the envelope to crack and thereby further weaken the previously weakened edges thereof and then separate the weakened edges by separating forces imposed perpendicularly to the panels of the envelope. The parallel shearing forces are created by conveying the envelope upon a belt which passes over a plurality of idler rollers in a tortious path which causes reverse flexures of the envelope sufficient to crack the weakened edges. The envelope is then conveyed between a conveyor belt and a drum. A vacuum plate beneath the belt cooperates through apertures in the belt to grip the lower panel of the envelope. Apertures within the drum through which a vacuum is induced, in a like manner, grip the top panel of the envelope. As the belt progresses, the diverging path of the belt and the surface of the drum separate the panels. A nip roller following the drum serves to aid in assuring the continuance of the envelope through the opening apparatus. Additionally, a pressure roller following the drum also serves to flatten or iron the envelope panels and contents.

Other objects and advantages of the present invention will become apparent to those skilled in the art from reading the detailed description thereof which follows taken in conjunction with the drawings.

DESCRIPTION OF DRAWINGS

FIGS. 12A and 12B are side elevation views of the misalignment detector of the present invention;

FIGS. 13 and 14 are a plan view and side elevation view respectively of the details of the paddle and operating means of the present invention;

FIGS. 25 and 26 are a plan view and side view respectively of the differential separator of the present invention.

DETAILED DESCRIPTION OF INVENTION

I. GENERAL COMPONENTS AND OPERATION — FIGS. 1-6

Figure 1:
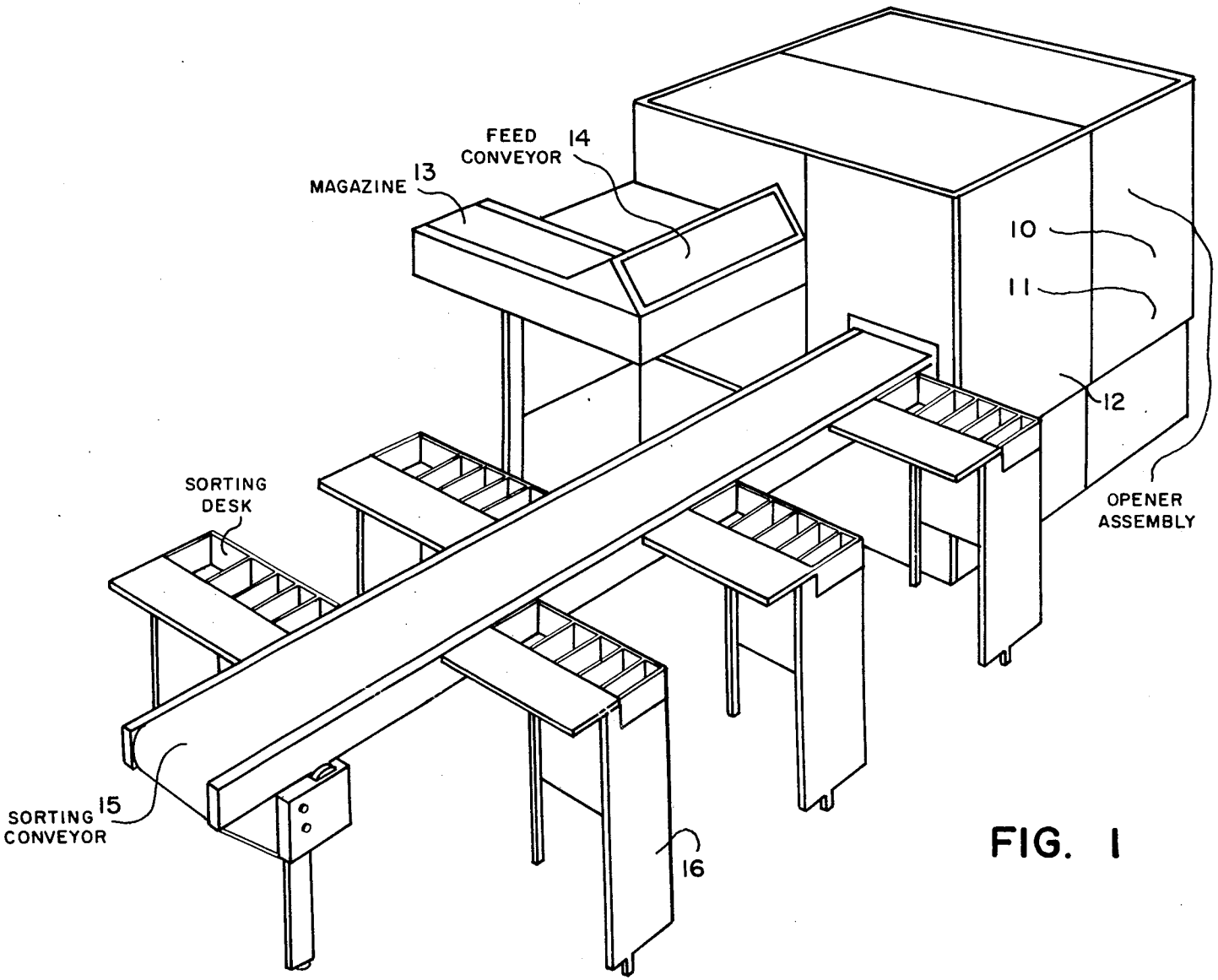
FIG. 1 is a perspective view of the envelope opening apparatus of the present invention assembled in a housing with cooperative feeding and sorting conveyors.

FIG. 1 of the drawings shows the general overall external appearance and arrangement of the major components and assemblies of the envelope opening apparatus of the present invention. The envelope opening mechanism is disposed within a housing 10 and will be described in detail hereinafter. The housing employs doors 11 and 12 which swing outwardly from the center to provide access to the assembly within the housing. The opposite side and adjacent end of the housing assembly 10 are so constructed with doors in a like manner.

The envelope opening apparatus within the housing 10 is fed envelopes from a feed magazine 13 and its associated feed conveyor 14 disposed on the left hand front side of the housing. The control buttons and other operating controls for the interior apparatus are positioned in the console adjacent to the magazine.

An elongate assorting conveyor 15 extends from within the opening assembly adjacent the feed conveyor as shown in FIG. 1. A plurality of sorting desks 16 are secured to the side frames of the sorting conveyor. During operation, one attendant tends to replenishing the supply of envelopes passing from the magazine through the feed conveyor to the opening apparatus. As the envelopes are opened, they are deposited on the sorting conveyor 15 and are sorted into the respective trays of the sorting desk 16 by personnel positioned at each of the sorting desks.

Figure 2:
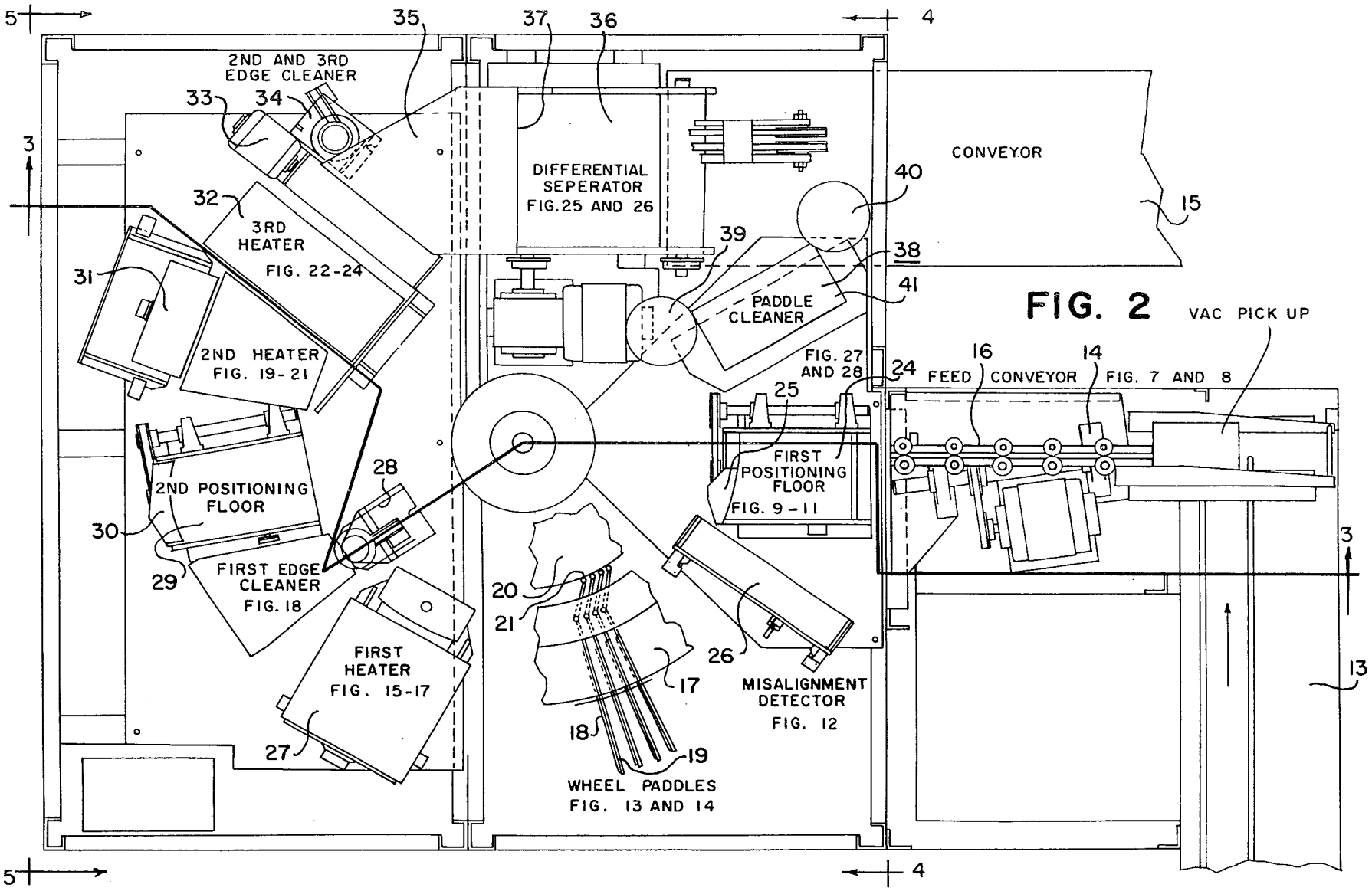
FIG. 2 is a plan view showing the relative positions of the various components of the envelope opening apparatus one to another and as respects the remaining figures of the drawings.

The overall and major components of the envelope opening apparatus of the present invention are shown in relationship one to another in FIGS. 2–6 of the drawings. Specifically, FIG. 2 is a plan view of the upper level of the opening apparatus wherein the actual opening operation is carried forth. This Figure is appropriately labeled showing the respective components involved in the opening operation and the Figures of the drawings wherein the details of that particular assembly are shown. For the purposes of clarity in disclosing the invention, the overall components will be broadly discussed regarding their respective relationship and operation one to another in conjunction with FIGS. 2–6. Thereafter, each of the particular components or assemblies involved will be described in detail in respect to the particular detailed Figures as indicated in FIG. 2.

Referring now generally to FIGS. 2–6, the envelopes to be opened are positioned on the magazine 13 standing on edge. The magazine 13 automatically conveys the bundle of envelopes to the feed conveyor 14. At the feed conveyor 14, the envelopes are, one at a time, picked up by a vacuum pick up which passes them into the feed track 16 of the feed conveyor 14.

The envelope opening apparatus employs a large rotating supporting wheel 17. The supporting wheel has secured thereto a plurality of matched complementary pairs of stationary paddles 18 and moveable paddles 19.

A second but stationary wheel 20, concentric with the moveable wheel 17, is positioned above the rotating supporting wheel 17. The stationary wheel 20 includes a plurality of cam lobes positioned around the circumference of the wheel at predetermined positions as will be later described. The cam lobes operate in conjunction with cam-followers 21 to effect opening and closing of the complementary paddle pairs.

One such cam lobe is positioned adjacent the exit end of the feed conveyor 16. As the supporting wheel 17 rotates, the paddle pair approaching the end of the feed track 16 will open. As may be seen more specifically in FIG. 3 a microswitch 22 is positioned above the top edge of the stationary paddle 18. An actuator link 23 is positioned on the upper and outer edge of the stationary paddle 18. As the wheel rotates past the microswitch 22 the actuator link 23 will actuate the microswitch. The microswitch is wired to the feed conveyor 14 to initiate the feeding of an envelope upon the actuation of the microswich representative of the arrival and opening of a complementary paddle pair.

A first positioning floor 24 is disposed adjacent the end of the feed track 16. This positioning floor is supported at an elevation slightly below the bottom edge of the paddle pairs and extends throughout their radial length. The positioning floor includes a plurality of rollers which are driven in a rotating direction to convey the envelope radially inwardly of the paddles. The positioning floor 24 employs a stop bar 25 on the inner edge positioned above the roller floor.

As an envelope is conveyed down the feed track 16, the envelope will pass between the opened paddles and upon the rollers of the positioning floor 24. The rotating rollers in the positioning floor will continue to convey the envelope into abutment with the stop bar 25. The position of the stop bar 25 is such that only a small portion of the inside edge of the envelope will remain exposed from the paddles.

Continued rotation of the supporting wheel 17 will cause the cam follower 21 to pass off of the cam lobe on the stationary wheel 20. As this occurs, the movable paddle will close upon the envelope firmly gripping the envelope and contents thereof with only the inside edge of the envelope remaining exposed from the paddles.

As the wheel 17 continues to rotate, the paddles and enclosed envelope pass by a misalignment detector 26. The misalignment detector, as described in more detail hereinafter, includes microswitches disposed on either side of the paddles which are actuated if the envelope is extending exposed from the paddles beyond a predetermined limit. If a misaligned envelope is detected, an audible alarm signal is triggered and the operator removes the mispositioned envelope through one of the side panels of the cabinet of the apparatus.

The envelope, as the wheel continues to rotate, is conveyed past a first heater assembly 27. The heater assembly includes a plurality of heaters which are positioned adjacent to the path of travel of the inside edge of the envelope but spaced a slight air gap distance from the edge of the envelope. As the envelope passes the heaters, the heat from the heaters carbonizes the inside edge of the envelope and weakens the envelope edge but does not sever the edge. The first heater 27 and its relationship to the paddles and envelope can best be seen from FIG. 5.

Continued rotation of the supporting wheel 17 next brings the inside edge of the envelope into contact with a first edge cleaner 29. The edge cleaner is a vertically disposed rotating cleaning member which engages the previously carbonized inside edge of the envelope. The edge cleaner serves to remove any residue from the inside edge of the envelope resulting from the carbonization. This process is helpful in the final opening operation of the envelope.

At this point in the opening operation, the inside edge of the envelope has been weakened, it is now necessary to reposition the envelope for treating of the outside edge and bottom edge of the envelope. This is accomplished in a second positioning floor 29. As the paddles approach the second positioning floor, the cam-followers 21 on the moveable paddles contact a second cam lobe on the stationary plate 20 causing the paddles to open. As this occurs the envelope within the paddles drops into engagement with the second positioning floor. The second positioning floor, like the first positioning floor, includes a plurality of driven rollers. However, the rollers in the second positioning floor are driven in a direction to convey the envelope radially outwardly of the paddles.

Figure 5:
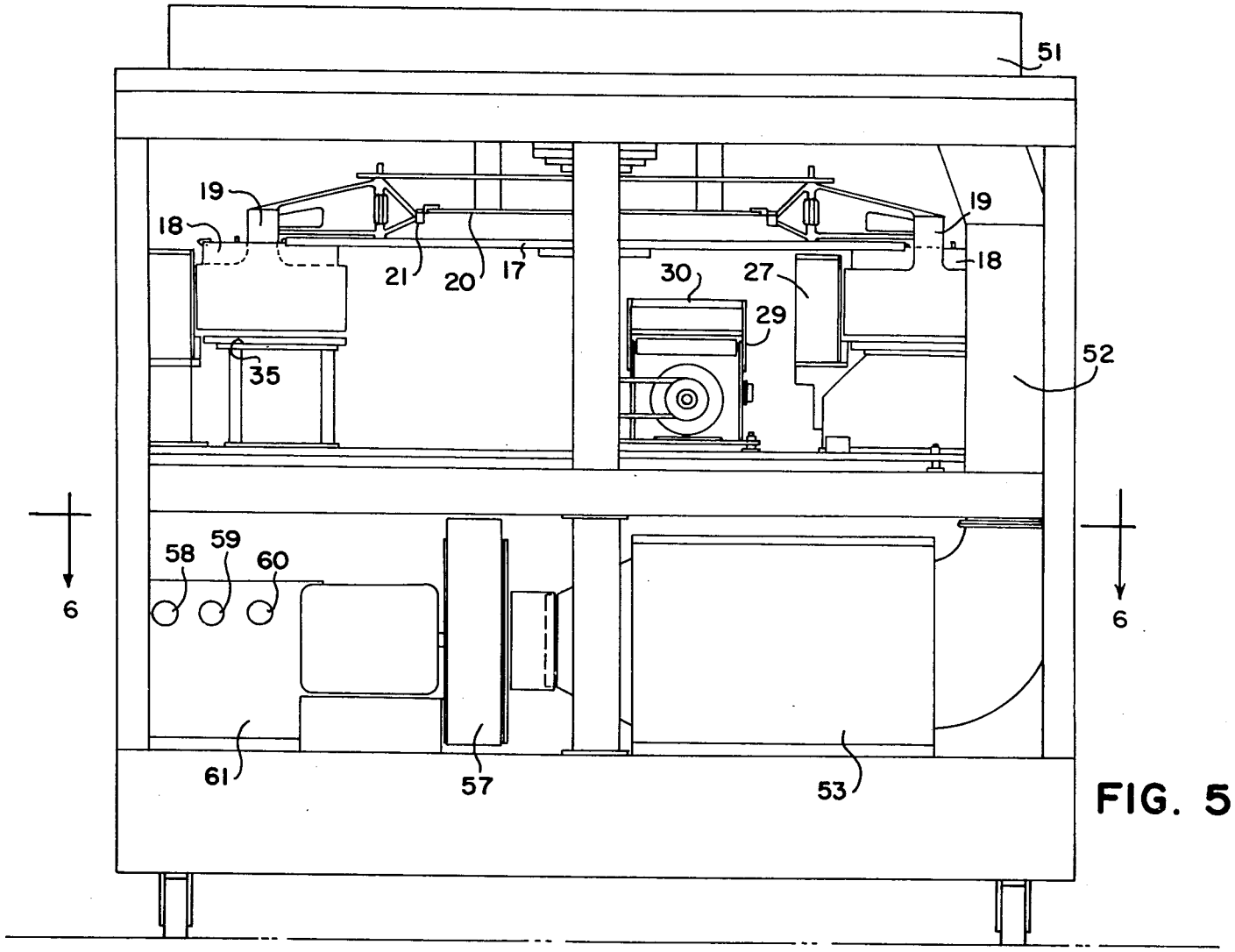
FIG. 5 is a side elevation view of the envelope opening apparatus taken along the lines 5—5 of FIG. 2.

As the envelope settles to the roller floor, the rollers will convey the envelope against a second stop bar 30. The second stop bar, like the first stop bar, is positioned so as to leave the outside edge of the envelope slightly exposed from the paddles. Additionally, the elevation of the second positioning floor below the paddles is such that the bottom edge of the envelope is left slightly exposed from the paddles. Continued rotation of the supporting wheel 17 will bring the cam-follower 21 off the cam lobe and cause the paddles to close in gripping relationship upon the envelopes. As this occurs, the outside and bottom edge of the envelopes are now slightly exposed for treatment of these edges. The roller floor 29 is best shown in FIG. 5.

The repositioned envelope now passes to a second heater assembly 31. The second heater assembly 31, like the first heater assembly, includes a plurality of heater elements but this time disposed on the outer circumferential path of travel of the outside edge of the envelope. In a like manner, the outside edge of the envelope is carbonized to weaken the edge.

Figure 3:
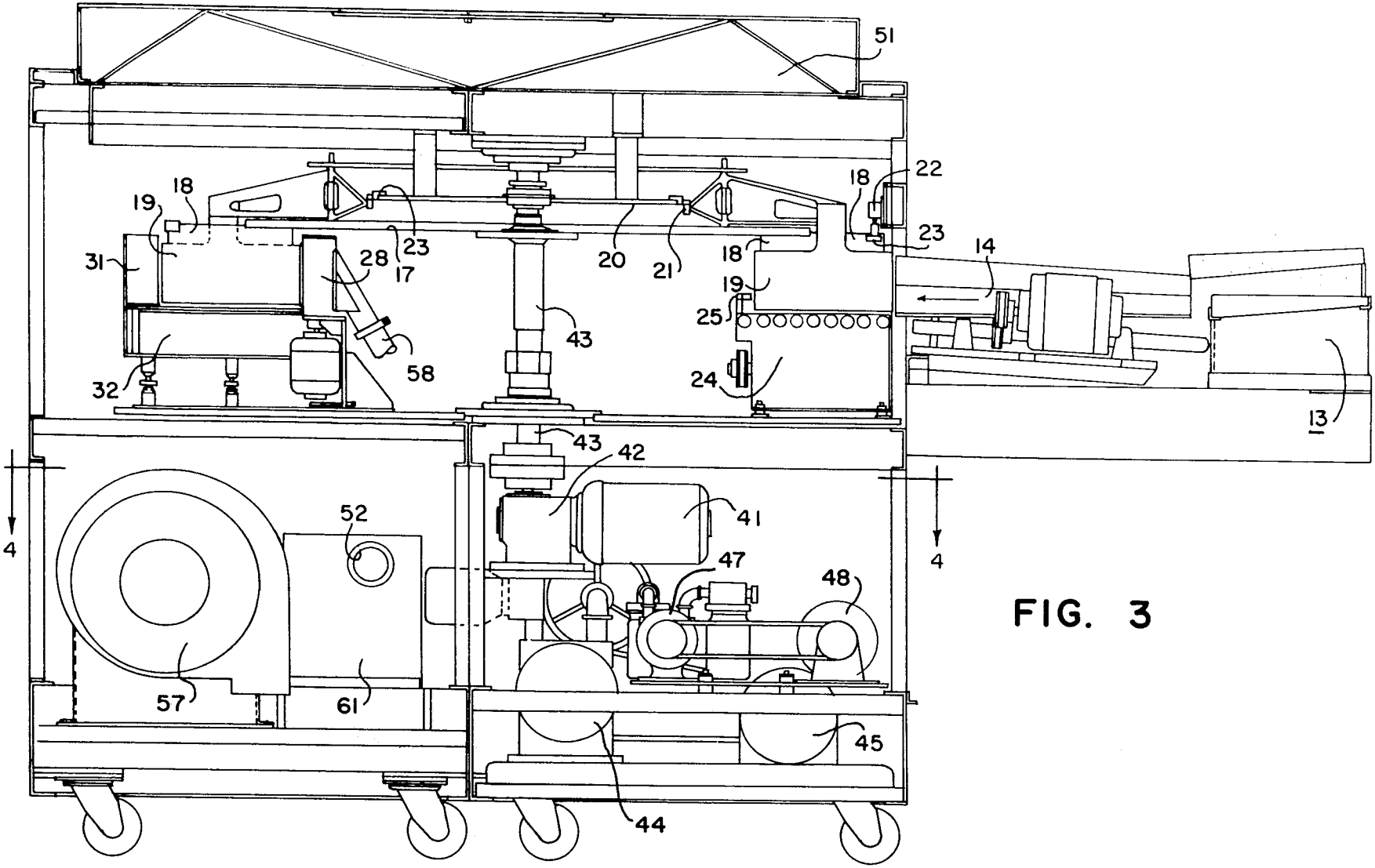
FIG. 3 is a side elevation view of the opening taken along the line at 3—3 of FIG. 2.
Figure 4:
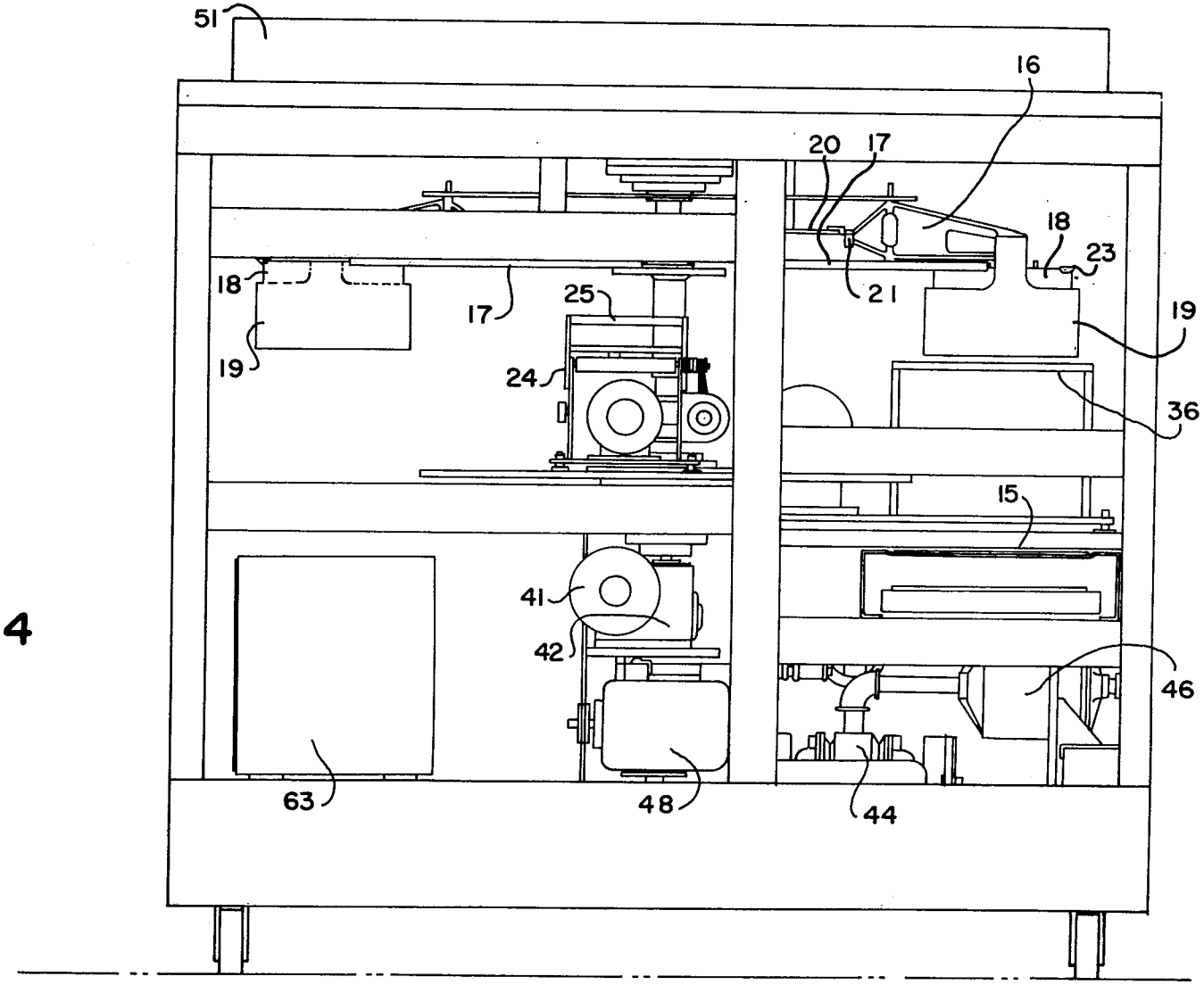
FIG. 4 is a side elevation view of the apparatus of the present invention taken along the line 4—4 of FIG. 2.

Immediately following the second heater assembly 31 is a third heater assembly 32. This heater assembly is positioned beneath the bottom edge of the envelope at a slight air gap distance from the bottom edge. This heater assembly, as the first and second heater assemblies, serves to carbonize and weaken the bottom edge of the envelope. The second and third heater assemblies are best seen in FIG. 3.

A bottom edge cleaner 33 and outside edge cleaner 34 are positioned immediately following the second and third heaters. The bottom edge and outside edge cleaner operate in the same manner as the first edge cleaner. Both cleaners employ elongate rotary members which engage the entirety of the bottom edge and outside edge of the envelope to remove any residue resulting from the carbonization of the envelope.

Continued rotation of the wheel now brings the envelope into position over a flat carrier plate 35. At this point, the cam-follower 21 on the moveable paddle again contacts a cam lobe on the stationary plate 20 and the paddles are opened. As this occurs, the envelope drops into contact with the carrier plate 35 which is positioned only a slight distance below the paddles. As the paddles continues to move, the envelope is still retained between the paddles but slides along the surface of the carrier plate 35.

The carrier plate has a trailing edge 37 which is positioned slightly above the receiving means of a differential separator 36. As the wheel continues to rotate, the envelope is moved smoothly to the trailing edge 37 of the carrier plate and, as it passes over the edge, the envelope is accurately dropped by gravity into the receiving means of the differential separator. The carrier plate serves to assure that the envelope will be deposited into the receiving means of the differential separator with the bottom edge in parallel alignment with the separator and not in a tilted or cocked position which can cause difficulties in the opening process.

The envelope is delivered to the differential separator, the envelope is first passed over a tortuous path which causes reverse flexures in the envelope and induces shearing forces parallel to the weakened side edges of the envelope. The envelope then passes through a diverging path wherein the opposite panels of the envelope are subjected to tensile forces parallel to the panels of the envelope to effect separating of the panels along the leading bottom edge of the envelope and the weakened side edges. The top panel of the envelope is then laid back in a trailing position and the envelope and its contents delivered to the conveyor 15 which continues past the sorting desks.

The pair of complementary paddle pairs, once having delivered their envelope to the differential separator, continue in their circular path past a paddle cleaning assembly 38. The cam-lobe on the stationary plate 20 maintains the paddles open during their passage of the cleaning assembly 38. The paddle cleaner 38 includes two vertically disposed cleaning rolls 39 and 40 and one horizontally disposed cleaning roll 41. Each of the three rolls engage the paddles and are free to rotate. The rolls are of lengths sufficient to engage the bottom and the side edges of the stationary and movable paddles. A cleaning fluid, as later described, is circulated through the rollers and aids the rollers in removing any residue adhering to the rollers resulting from the carbonization process.

The continued rotation of the wheel 17 toward the opening station brings the opened paddle pair into position for the receipt of another envelope thus completing the opening cycle for a given pair of paddles. The speed of operation of the opening device depends upon the number of paddle pairs employed and the speed of revolution of the wheel. In a preferred embodiment, the wheel includes 114 pairs of complementary paddles and operates at a speed of 0.58 revolutions per minute. At this speed, the apparatus is capable of receiving and processing 4,000 envelopes per hour.

The various pieces of apparatus shown in FIG. 2 require support equipment for their operation. The equipment, as shown in FIGS. 3–6, is disposed on a level below the apparatus shown in FIG. 2. The support equipment, as more specifically shown in FIG. 6, includes a wheel drive motor 41 and associated reduction gear 42 for revolving the wheel through a support axle 43.

The differential separator itself requires vacuum to operate. The vacuum is supplied by a separator vacuum pump 44 and its driving motor 45 which operate through an air filter 46 to provide the desired vacuum. A further vacuum pump 47 and driving motor 48 are employed to provide the vacuum source for the vacuum feed pick up assembly.

The paddle cleaning assembly 38 disposed on the upper lever requires fluid circulation. This is provided by means of a water pump 49 and its driving motor 50 likewise disposed on the lower level and appropriately plumbed to provide circulation at the paddle cleaning assembly.

Figure 6:
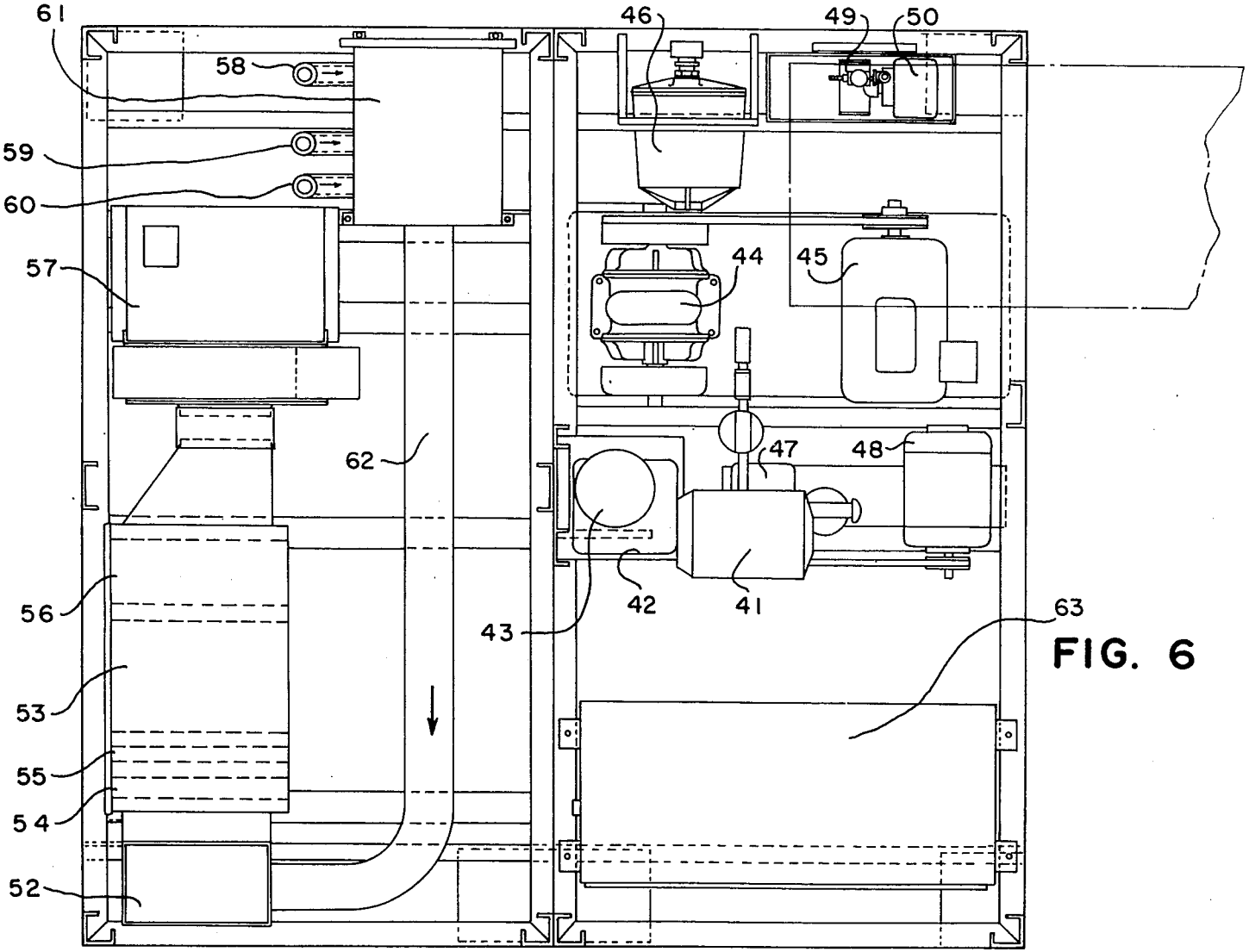
FIG. 6 is a plan view of the supporting equipment positioned below the apparatus shown in FIG. 2 and as taken along the lines 6—6 of FIG. 5.

The operation of the heater assemblies generate some minor amount of smoke and fumes. Any resultant smoke and fumes will rise by natural convection to the top of the housing. At the top of the housing, as best shown in FIG. 5, is positioned a fume collection hood 51. A large duct 52 is connected to the fume collection hood and leads to the lower level as best shown in FIG. 6. At this point, a duct 52 leads to a filter box 53 that includes therein a dry filter 54, an absolute filter 55 and a charcoal filter 56. At the opposite end of the filter box is a suction blower 57 which induces the draft from the fume collection hood through the duct and filler box.

The cleaning assemblies for cleaning the inside, outside and bottom edges of the envelopes may, in one embodiment, be abrasive wheels. Where abrasive wheels are used, they can, themselves, contribute to the weakening of the edges of the envelope by means of the abrasive action of the wheels.

When the abrasive wheels are used, a certain amount of dust or powder is generated by the abrasive action. In this case, the abrasive wheels are equipped with a vacuum pick up to collect the resulting dust. This vacuum pick up is provided by means of ducting 58, 59 and 60 which leads from the respective cleaning apparatus to a vacuum plenum chamber 61 located in the lower section of the envelope opening apparatus. A duct 62 is provided between the plenum chamber 61 and the suction duct 52 leading to the main suction blower to provide the suction through the plenum chamber. The resultant air flow from the edge cleaners will carry the dust to the plenum chamber wherein a large particle size filter is employed. Any finer materials which pass through the duct 62 will be captured in the filter box 53.

Lastly, an electrical control box 63 is positioned in the lower level of the machine. The control box 63 includes most of the circuitry and control apparatus for the operation of the equipment as to be later described.

II. ENVELOPE FEED CONVEYOR — FIGS. 7 and 8

Figure 7:
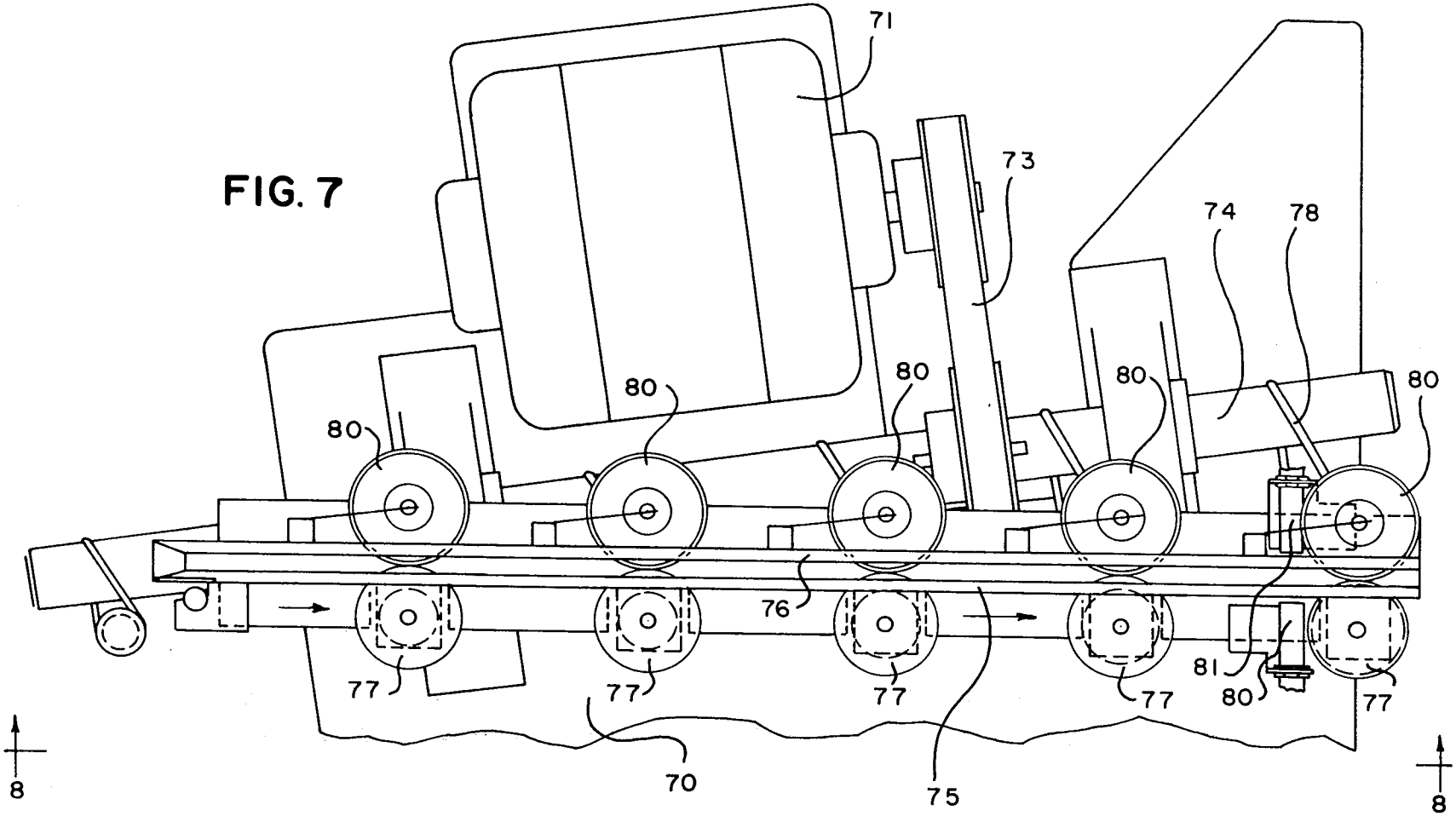
FIG. 7 is a plan view of the envelope feeding apparatus of the present invention.
Figure 8:
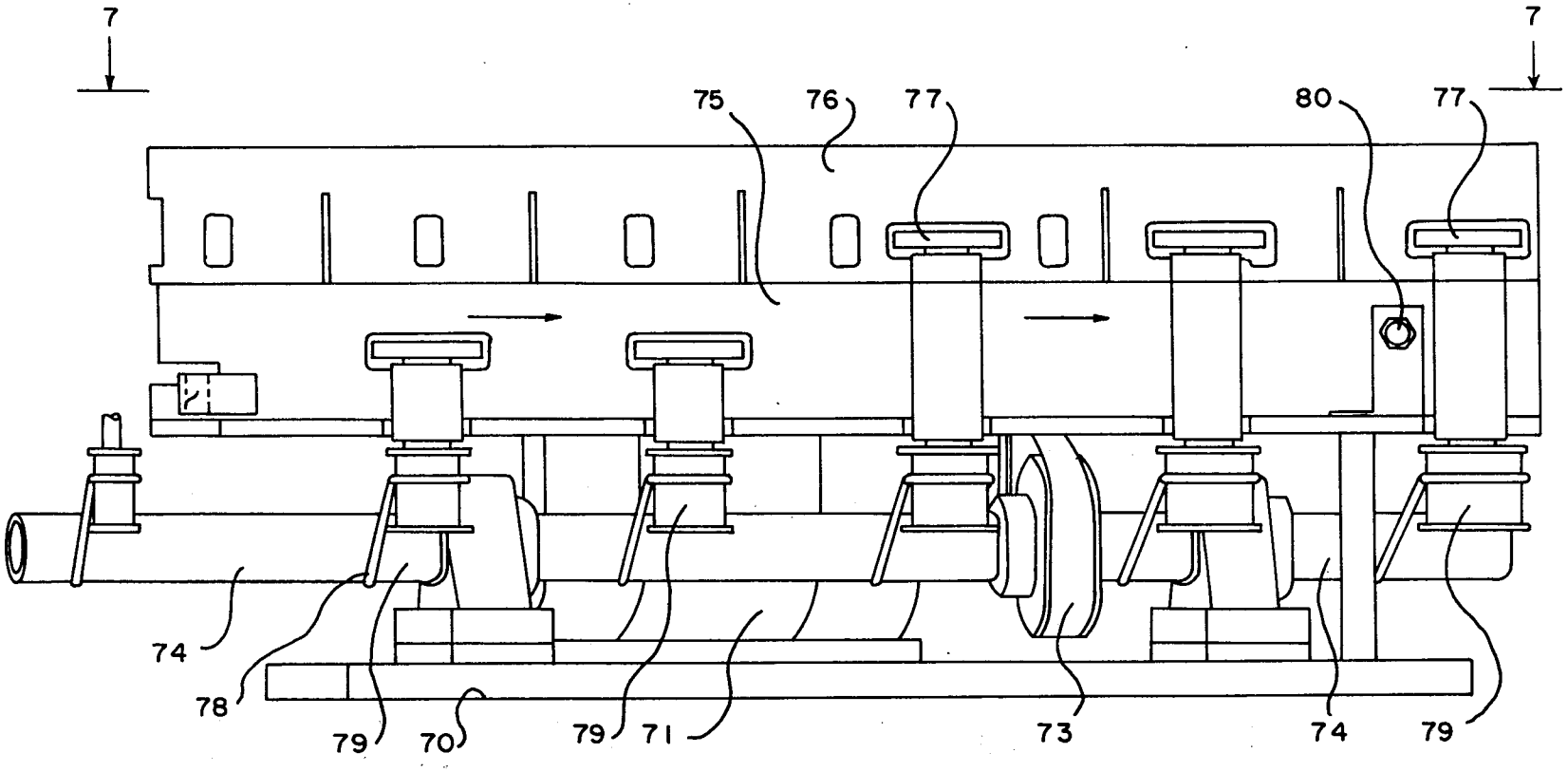
FIG. 8 is a side elevation view of the envelope feeding apparatus shown in FIG. 7.

The details of the envelope feed conveyor employed in the present invention are shown in FIGS. 7 and 8 of the drawings. The feed conveyor 14 essentially employs a frame 70 upon which a drive motor 71 operating through cooperating pulleys and drive belt arrangement 73 operates to drive a common drive shaft 74 suitably journaled upon the supporting plate 70. Additionally supported on the supporting plate 70 are a pair of parallel vertically disposed guide rails 75 and 76.

The guide rail 75 provides the support for a plurality of driving pulleys 77. Each of the drive pulleys is driven by means of a rubber drive belt 78 interposed between the common drive shaft 74 and lower pulley 79 on each of the driven pulleys. In a like manner, the parallel guide rail 76 provides a support for a plurality of idler pulleys 80. The idler pulleys are exactly opposite from the driving pulleys and their circumferences run in engagement one with another.

In operation, the feed mechanism removes an envelope from the magazine and inserts the envelope between the first pair of opposed driving and idler pulleys on the left hand side of FIG. 7. The action of the driving and idler pulleys removes the envelope from the feeding mechanism and conveys the envelope in the direction of the arrow in FIG. 7 toward the open paddles of the envelope opening apparatus.

The pulleys 79 on the driven pulleys are larger on those driving pulleys at the entrance end than at the exit end of the envelope feeding conveyor. In this manner, the envelope is taken from the feeding mechanism at a slower speed and is accelerated in its path of travel down the feed track. The initial pick up speed is approximately 50 inches per second and the delivery speed at the following end of the track is approximately 75 inches per second.

A photocell 80 and cooperating light 81 are positioned after the exit end of the feed conveyor. The photocell-light combination senses any envelope which has jammed in the feed conveyor. As hereinafter described, this is used to discontinue any further feeding of the envelopes.

III. A TYPICAL POSITIONING FLOOR — FIGS. 9 - 11

Figure 9:
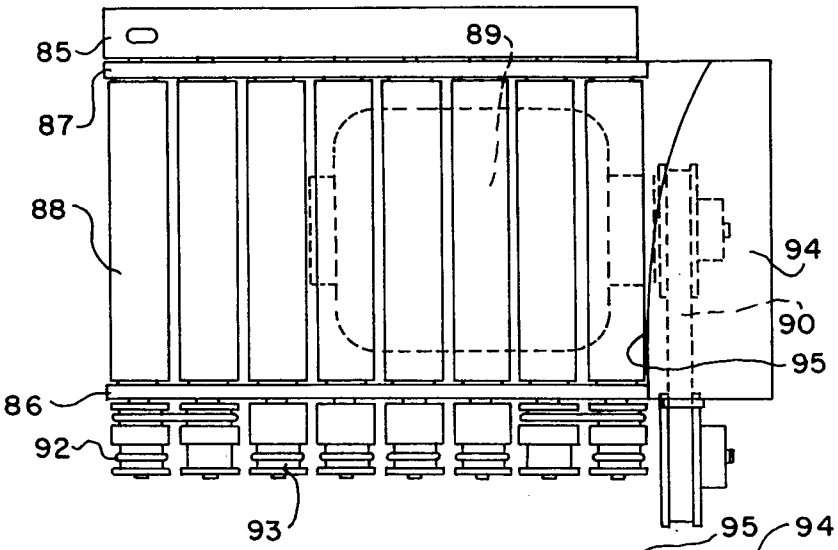
FIGS. 9 - 11 are a plan view and two side elevation views respectively of a typical roller floor of the present invention.
Figure 10:
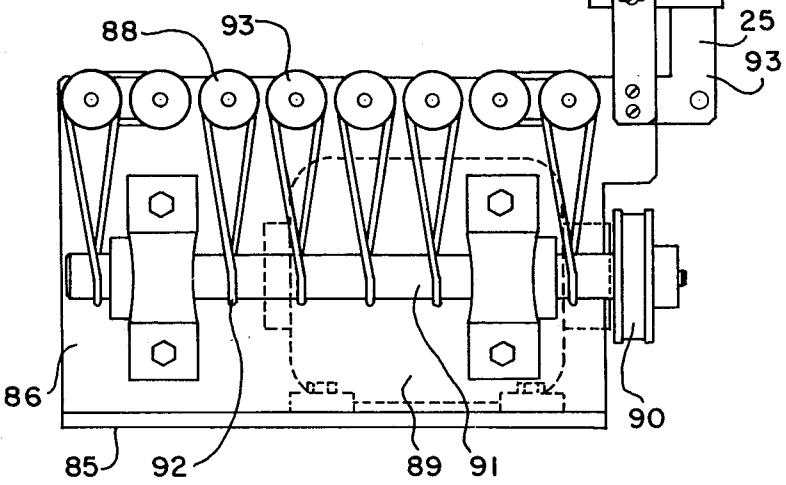
Figure 11:
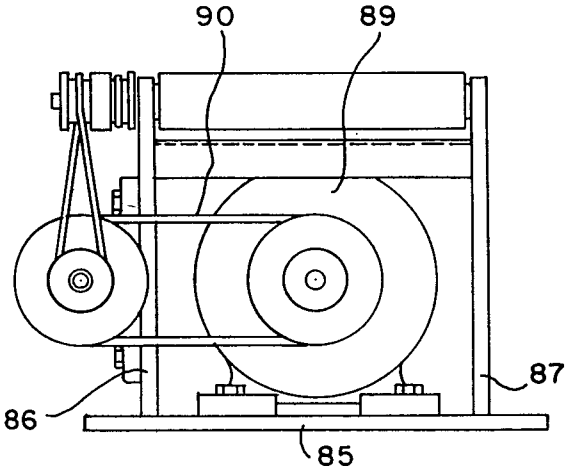

The details of the first positioning floor 25 are shown in FIGS. 9 - 11. This floor is typical of the construction of the second positioning floor 29 except that the stop bar is positioned on the opposite side and the direction of rotation of the rollers is reversed. Accordingly, only a detailed description of the first roller floor will be given.

The roller floor 25 includes a bottom support member 85 and parallel opposed side frame members 86 and 87. The side frame members 86 and 87 provide the support for the journals of a plurality of equal length and diameter rollers 88.

The rollers are driven by means of a drive motor 89 which operates through a pulley and belt combination 90 to drive a common drive shaft 91 which is appropriately journaled below the ends of the pulleys and runs for the width of the pulleys. A plurality of drive belts 92 are suspended between the drive shaft 91 and pulleys 93 secured to the ends of each of the rollers 88.

The motor speed and pulley arrangement is such that the rollers 88 are driven in a clockwise direction looking at FIG. 10. The circumferential speed of the rollers is 2,700 inches per minute.

The side frame members 86 and 87 also provide the support for the stop bar 25. The stop bar includes two upwardly extending arms 93 at each side of the rollers. An abutment bar 94 is suspended between the two arms 93. The inside face 95 of the abutment bar is radially curved to follow the path of travel of the inside edge of the paddles as they pass by the roller floor.

As earlier mentioned, the second positioning floor 29 is essentially the identical structure of the roller floor of FIGS. 9 - 11. The only difference is that the stop bar is positioned at the opposite end radially outwardly from the center of the wheel and the rollers operate in a counter clockwise dirction rather than clockwise.

IV. ENVELOPE MISALIGNMENT DETECTOR — FIGS. 12A and 12B

The misalignment detector of the present invention is shown in FIGS. 12A and 12B of the drawings. The misalignment detector includes a base plate 100 with two upstanding vertical support arms 101 and 102. The vertical support arms 101 and 102 carry a support 103 which is a generally U-shaped section. The support plate is positioned in the path of travel of the paddle pairs, as shown in FIG. 12A, such that the paddles and included envelope pass through the U of the support plate.

On either side of the support plate is a detector bar 107 which is secured by means of hinges 109 to the support plate 103. A micro-switch 105 and its actuator 106 are secured to the upper portions of the support plate 103 with the cam-actuator in engagement with the detector bar 107.

The spacing between the inside edges of the two detector bars 107 is set to provide only a slight air gap between the edges of the detector bars and the inside and outside edges of the paddle pairs. Any envelope which is improperly positioned so as to be exposed beyond the paddle pairs more than the predetermined and desired distance will engage either one of the actuator bars causing it to actuate the microswitch. When this occurs, as hereinafter described in respect to the electrical circuits employed, an audible alarm will be sounded which will advise the operator that an envelope is mispositioned. The operator then may open the side panel of the housing of the envelope opening apparatus and remove the mispositioned envelope.

V. WHEEL AND PADDLE DETAILS - FIGS. 13 and 14

The details of the complementary paddle pairs and their actuating mechanism is shown in FIGS. 13 and 14 of the drawings. The main support wheel 17 is supported at its center of rotation and the stationary paddles 18 are positioned radially around the outer circumference of the wheel. The top portions of the stationary paddles 18 are secured by conventional threaded fastener means to the under surface of the wheel 17.

The movable paddle 19 has a face which is complementary to the paddle 18 but also includes an upper arm 120 thereon which extends above the upper surface of the wheel 17 and beyond the outer circumferential edge thereof. This upper arm 120 of the movable paddle is secured to a hinge arm 116. The hinge arm midway of its length is journaled upon a hinge pin 117 which has one end thereof pivotally secured in the wheel 17 and the upper end thereof likewise pivotally secured in an anchor pate 115. The anchor plate 115 is rigidly secured to the wheel 17 and rotates with the wheel.

The inside end of the pivot arm has journaled thereon a cam-follower 21. The cam-follower 21 is positioned at the same height as a stationary cam-plate 20 which is disposed intermediate the anchor plate 115 and wheel 17. The stationary cam-plate 20 has thereon a cam lobe 118.

As the wheel 17 and anchor plate 115 rotate, the cam-follower will come upon the cam-lobe 118 and the hinge arm 116 will be hinged backwardly. As this occurs, the hinge arm will pull the moveable paddle 19 away from the stationary paddle 18 thus opening the paddle pair. A return spring 119 is secured between the upper edge of the moveable paddle and the stationary paddle. As the wheel rotates to a point where the cam-follower moves off of the cam-lobe the spring will assure return of the moveable paddle to the stationary paddle.

The moveable paddle has its inside, outside and bottom edges flared slightly inwardly. This inward flare provides a more positive and tighter grip uon the edges of the envelope and also provides space between the paddles for accommodation of such matters as coins, credit cards and varying thicknesses of the envelopes.

VI. INSIDE EDGE OPENER — FIGS. 15 - 17

Figure 15:
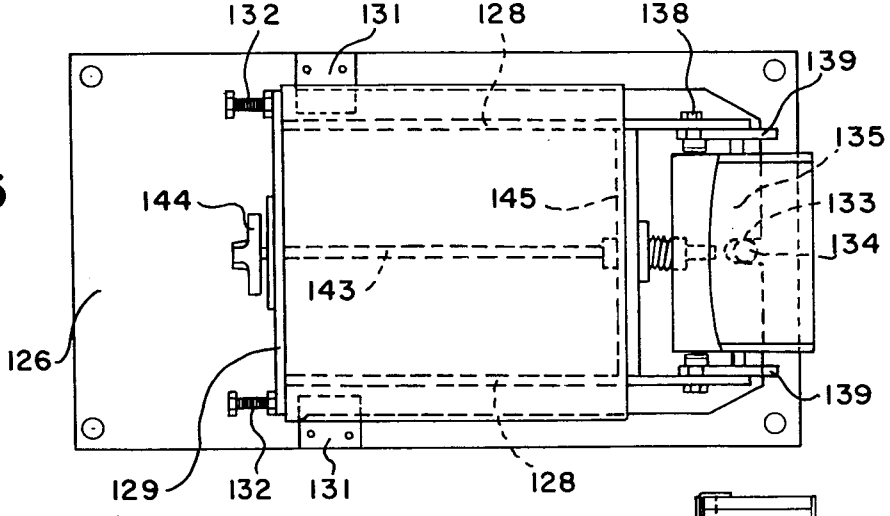
FIGS. 15 - 17 are a plan view and two side elevation views respectively of the heater assembly for treating the inside edge of the envelope.
Figure 16:
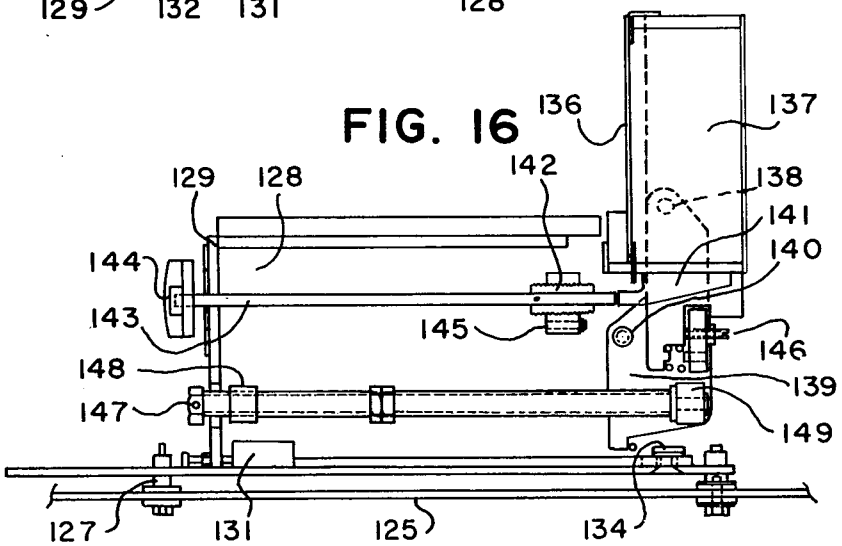
Figure 17:
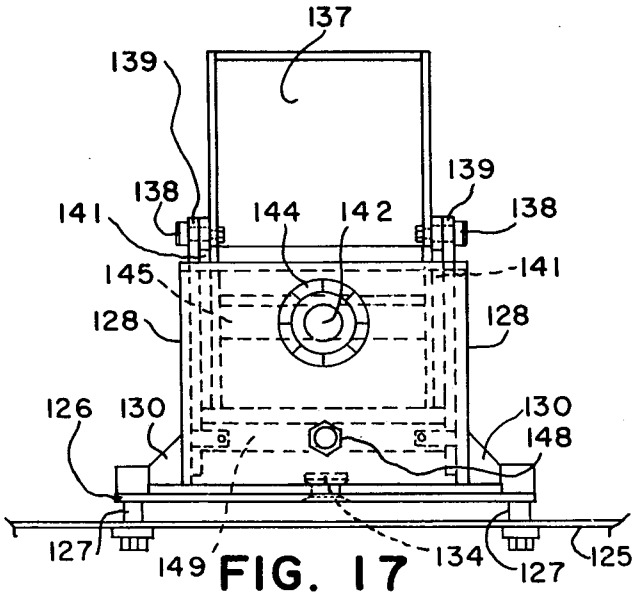

The inside heater assembly is shown in detail in FIGS. 15-17. The entire assembly is carried upon a structural member 125 odf the main frame of the opening apparatus. The heater assembly includes a base plate 126 which is secured to the structural member 125 by means of adjustable screw legs 127. In this manner, the vertical elevation and adjustment of the heater assembly is obtained.

A pair of opposed side plates 128 are secured to the base plate 126 and extend upwardly therefrom. An end plate 129 is secured to the ends of the side plate, 128 and to the base plate 126 in a conventional manner. Angle braces 130 extend along the lower portions of the side plates 128 and into the end plate 129 to form the bottom edge of the side plate - end plate assembly. A pair of guide ways 131 disposed on either side of the angle braces cooperate with adjusting screws 138 to provide radial adjustment of the entire heater assembly. The opposite end of the heater assembly is maintained in line by means of a slot 133 in a bottom plate 135 which cooperates with a guide pin 134 in the base plate 126.

The actual heater elements 136 are carried along the front edge of an insulated back support 137. The entire back support and included heater elements is pivotally supported upon a pair of pivot pins 138 which are journaled within a pair of parallel support arms 139. The support arms 139 are, in turn, supported upon a pair of pivot pins 140 secured into the side walls 128.

The insulated back support includes a pair of depending support arms 141 which are pivoted upon the pivot pins 138 and also secured to the insulated back support. The support arms 141 are connected to a jack-screw 142 which is operated by means of a shaft 143 and knob 144 journaled in the plate 129. As the knob 144 is rotated, the jack-screw 142 will operate through the stationary support bar 145 to make minor adjustments in the vertical inclination of the heaters as is required. A set screw 146 determines the maximum forward inclination obtainable to guard against engagement of the heaters with the paddles.

A second jack-screw 147 is secured in place against the side walls by a cross frame member 148. The opposite end of the jack-screw threads into a pivoting cross bar 149 connected between the support arms 139. As the jack-screw is operated, the engagement of the screw with the cross bar 149 pivots the entire insulated back support and support arms upon the pivot pins 40 to substantially a horizontal position. This provides access to the heater assembly for service and repair.

VII. TYPICAL EDGE CLEANER — FIG. 18

Figure 18:
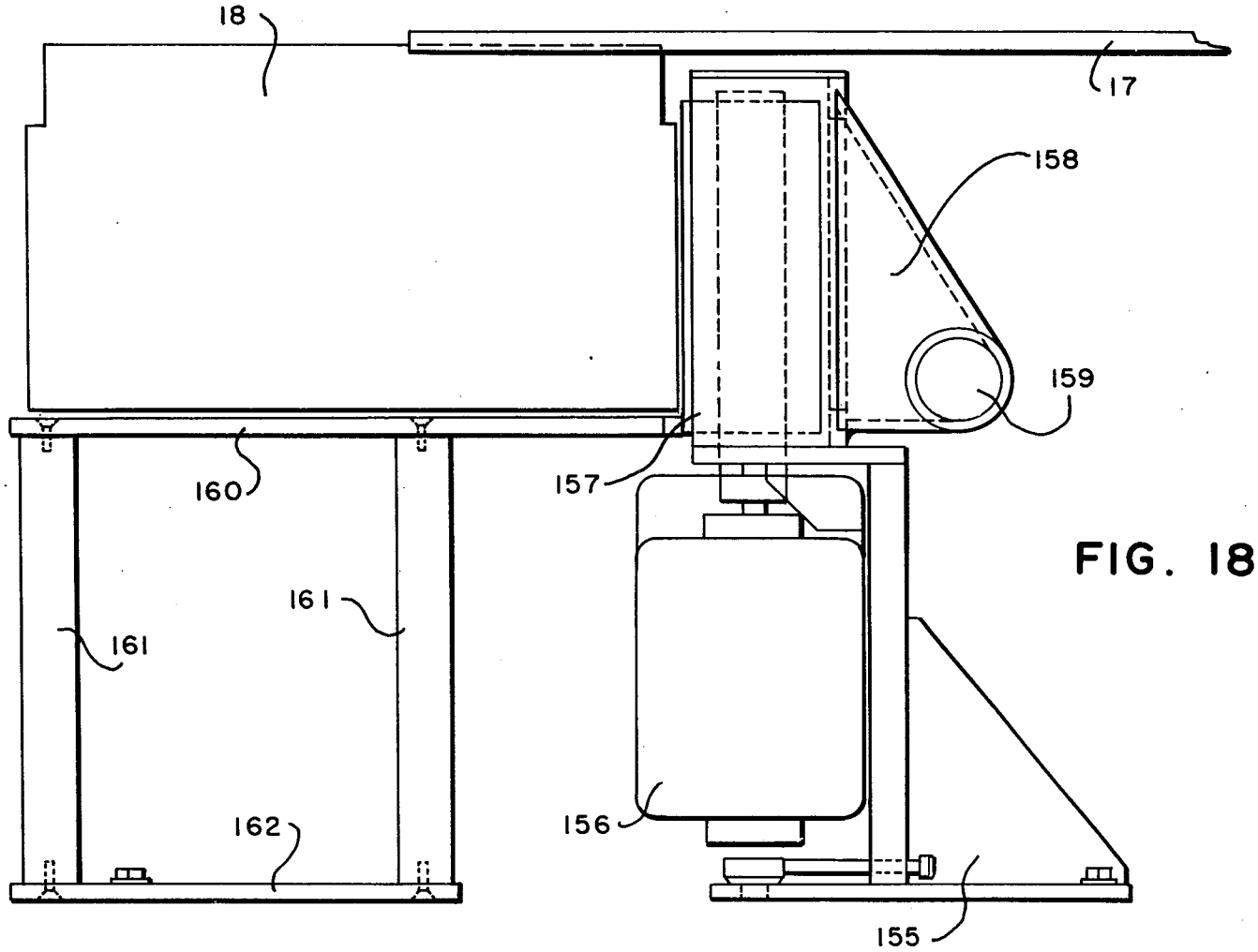
FIG. 18 is a side elevation view of a typical envelope edge cleaning apparatus.

The first inside edge cleaner 28 is shown in detail in FIG. 18. The cleaner includes a base plate 155 which provides the support for a motor 156. The drive shaft of the motor is directly connected to the center shaft of a cleaning roller 157. The motor operates at 1,750 rpm and thus drives the cleaning wheel 157 at the same rpm.

A vacuum housing 158 surrounds the cleaning wheel 157 and terminates in a duct 159 which leads to the vacuum plenum 61 earlier described.

The entire assembly of the motor and cleaning wheel is positioned directly under the rotating wheel 17 and just adjacent the inside edge of the envelope which has been weakened is exposed to the cleaning action of the cleaning wheel 57 as it passes the wheel.

A positioning floor 160 is positioned immediately below the bottom edge of the paddles. The stationary floor is supported in place by a pair of vertica uprights 161 which are, in turn secured to a base pate 162. The function of the positioning floor 160 is to prevent the envelope between the paddle pair from moving out of position between the paddles due to the scrubbing action of the cleaning wheel 157 upon the side edge of the envelope.

In one embodiment of the invention, the cleaning wheel 157 may be an abrasive wheel. When the abrasive wheel is used it is necessary to use the vacuum housing 158 through which the resultant dust from the grinding operation are drawn through the duct 159 as earlier described.

The bottom edge cleaner 33 and outside edge cleaner 34 operate in an identical manner. The outside edge cleaner is essentially the same construction as the inside edge cleaner. The bottom edge cleaner is, likewise, essentially the same except that it is horizontally positioned rather than vertically. Both of the outside and inside edge cleaners likewise employ the vacuum housing and ducts and for the same reasons. Accordingly, it is not believed necessary to show the details of the outside and bottom edge cleaners due to their similarity to the inside edge cleaner just described.

VIII. OUTSIDE EDGE OPENER — FIGS. 19-21

Figure 19:
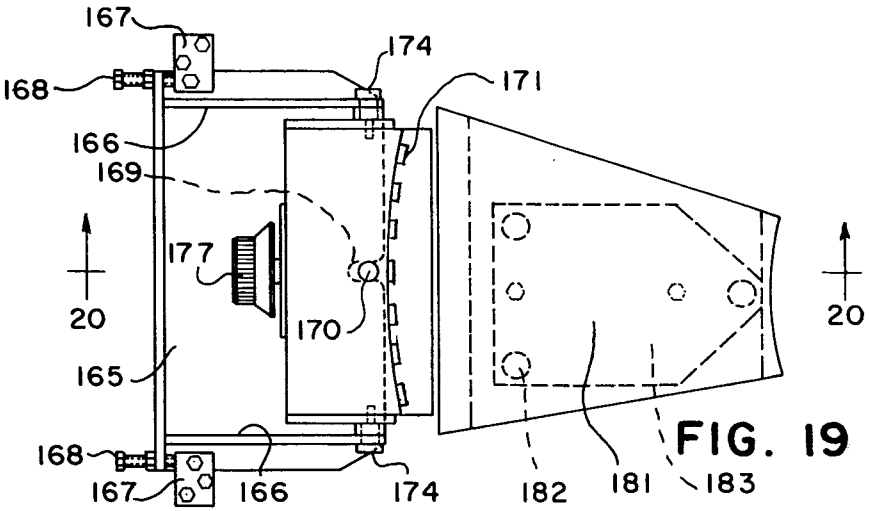
FIGS. 19 - 21 are a plan view and two sides elevation views respectively of the heater assembly for treating the outside edge of the envelope.
Figure 20:
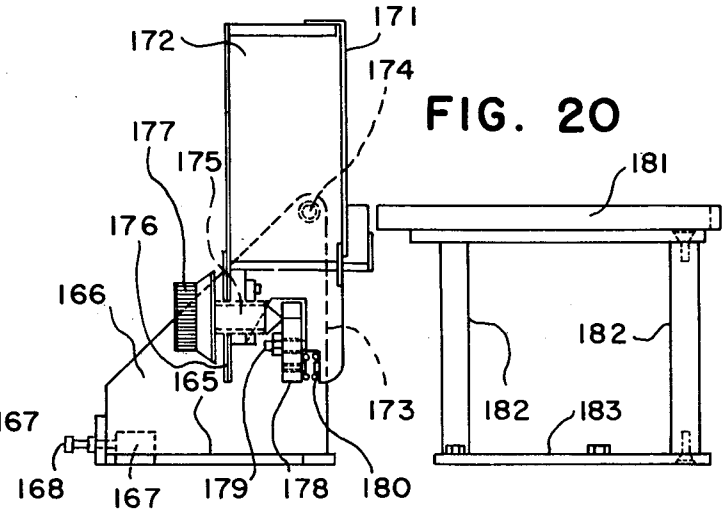
Figure 21:
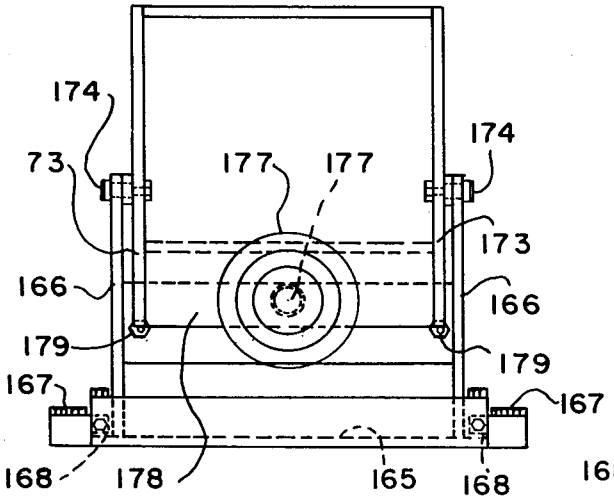

The outside edge heater is shown in FIGS. 19-21 of the drawings. The assembly includes a base plate 165 and a pair of upwardly extending side plates 166. A pair of guide blocks 167 operate in conjunction with adjusting bolts 168 to provide radial adjustment of the heater in respect to the paddles. The opposite end of the base plate 165 is maintained in alignment by means of a slot 169 which cooperates with a guide pin 170 anchored into the frame of the envelope opening machine.

A plurality of heaters 171 are disposed in an accurate manner upon the front edge of an insulated back support 172. The lower portion of the insulated back support 172 forms parallel pivot arms 173. The insulated back support 172 and its included pivot arms 173 are supported between the vertical side members 166 by means of a pair of pivot pins 174.

Vertical inclination of the heaters in respect to the paddles is accomplished by means of a jack-screw 175 which is secured into a lower panel 176 of the insulated backing support. The jack-screw is operated by means of a turning knob 177. As the jack-screw is turned, the opposite end of the jack-screw bears against a stop bar 178. Advancement or reversal of the jack-screw will incline the backing support 172 accordingly.

The maximum degree of a forward inclination of the heaters with respect to the paddles is controlled by a stop screw positioned in the stop bar 178. A pair of coil compression springs disposed between the stop bar 178 and the arms 173 of the backing support insure following of the backing support with the rotation of the jack-screw.

A floor plate 181 is positioned adjacent the outside heater assembly and is spaced slightly below the bottom edge of the paddles. The floor is supported by means of a pair of vertical supports 182 which extend into a base plate 183. The floor assures against mispositioning of the envelope as the envelope passes the heater assembly.

IX. BOTTOM EDGE OPENER — FIGS. 22-24

Figure 22:
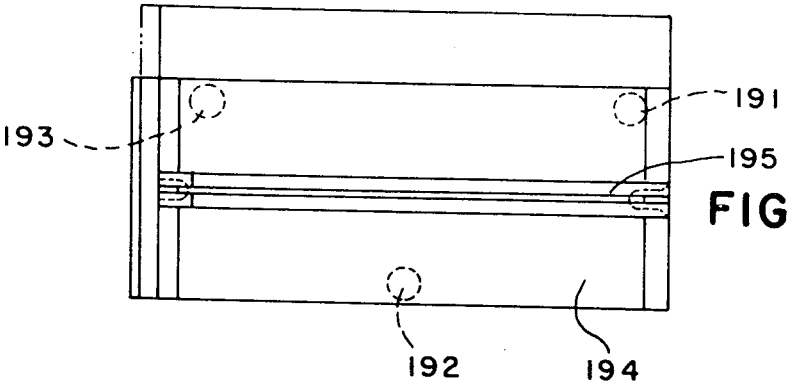
FIGS. 22 - 24 are a plan view and two side elevation views respectively of the heater assembly for treating the bottom edge of the envelope.
Figure 23:
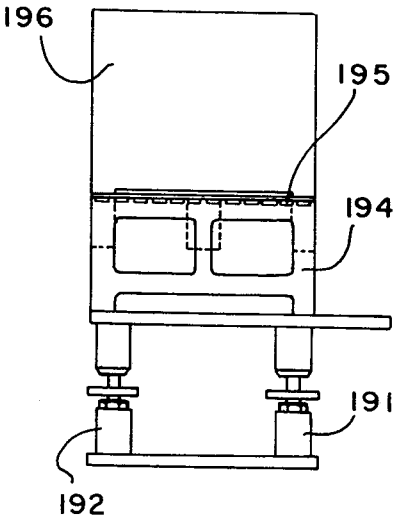
Figure 24:
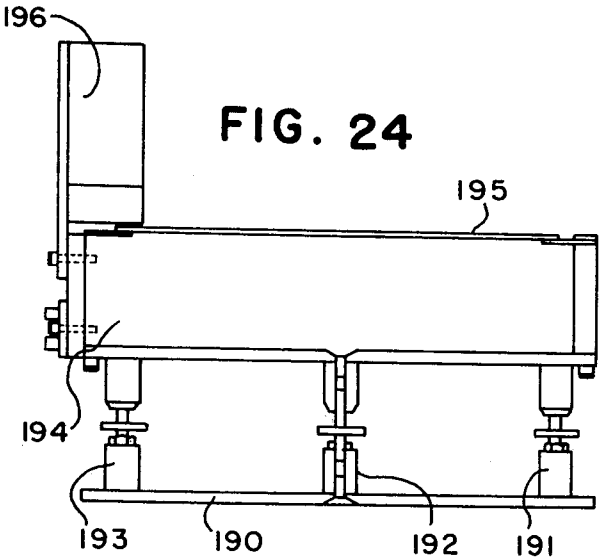

The bottom edge opener of the present invention is shown in FIGS. 22-24. The bottom heater includes a base portion 190 from which three adjustable leg supports 191, 192 and 193 extend. The three legs are positioned in a triangular fashion and, in this manner, provide both height adjustment as well as double planer tilt adjustment.

The three support legs provide the support for an insulated housing 194. A plurality of heaters 195 are positioned in a parallel fashion along the upper surface of the insulated housing 194. The entire assembly is positioned slightly under the bottom edge of the paddles as heretofore described.

The bottom heater assembly also includes an insulated vertical extending backing member 196 which is carried by the insulated housing 194. The backing member 196 is positioned with a slight clearance from the outer edges of the paddles. The insulated backing member serves to concentrate the heat in the region of the heater assembly and prevent stray radiation.

X. DIFFERENTIAL SEPARATOR — FIGS. 25-26

Figure 25:
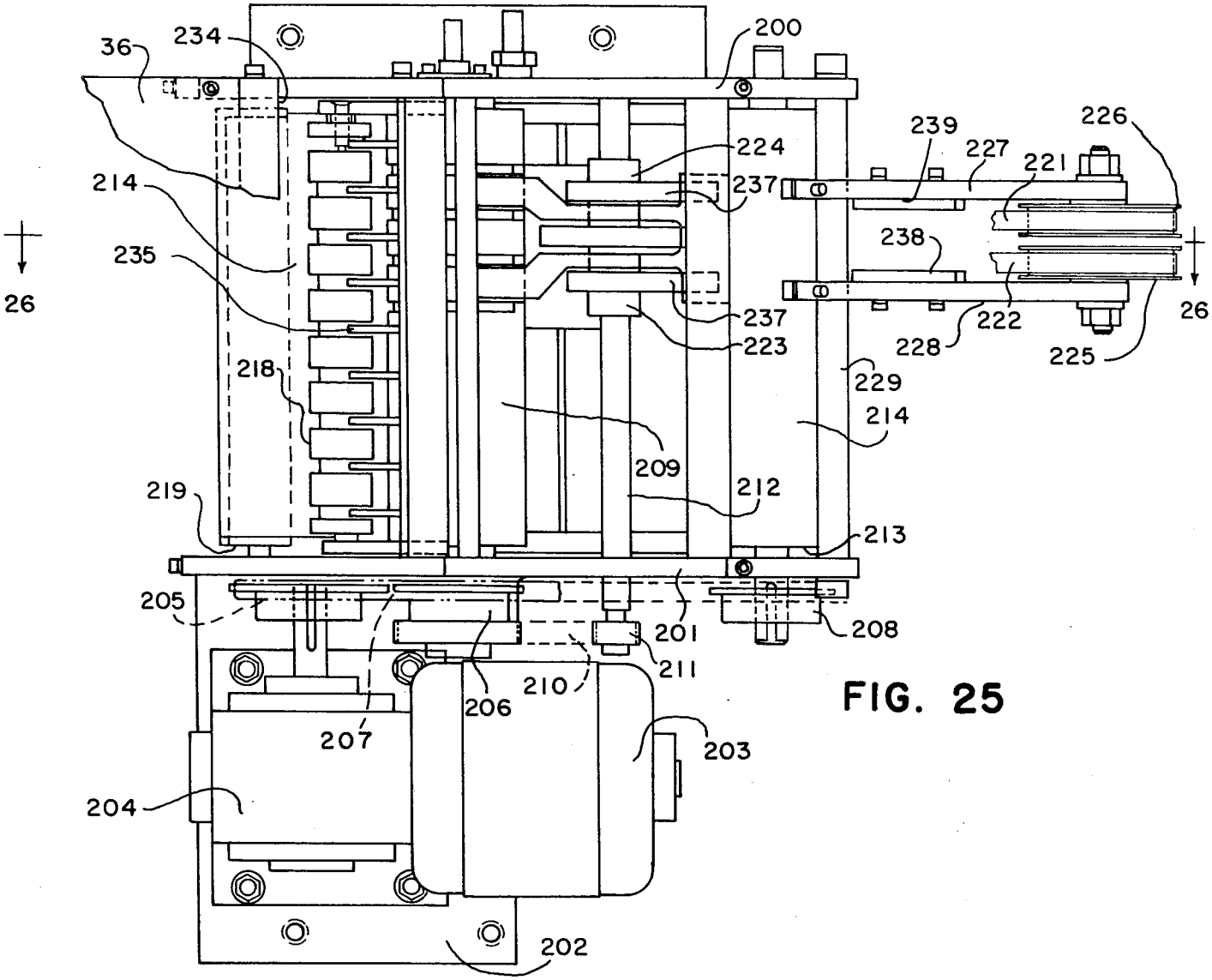

The differential separator of the present invention is shown in FIGS. 25 and 26 of the drawings. The differential separator includes two side frame members 200 and 201 which provide the support for a plurality of rollers and shafts journaled between the members as hereinafter described. Side frame 201 also provides the support for a platform 202 upon which a drive motor 203 and reduction gear 204 are disposed. The output of the reduction gear 204 is to a first sprocket drive 205 which operates through a sprocket chain 207 to drive a dual sprocket 206 and a single sprocket 208.

The dual sprocket 206 is keyed to a vacuum roll 209 and drives that roll. Additionally, the dual sprockets 206 provide the input, via a sprocket chain 210, to a driven sprocket 211. The driven sprocket 211 is keyed to and drives shaft 212 which operates a plurality of ironing rollers as hereinafter described. Lastly, the singular sprocket 208 is keyed to and drives a belt drive roller 213.

Referring more specifically to FIG. 26, belt drive roller 213 provides the input power to an endless belt 214. The belt is positioned around a larger tension roll 215 and a series of five idler rollers 216 - 220 and finally returns by means of vacuum roll 209 to the belt driving roll 213. The position of the idler rollers 216 - 220 are so disposed as to form a tortuous path to be described hereinafter.

The differential separator further includes a second pair of belts 221 and 222. These belts are trained over a first pair of idler pulleys 223 and 224 and pass around a second pair of larger idler pulleys 225 and 226. The idler pulleys 225 and 226 are supported upon a pair of spaced support arms 227 and 228 which are pivotally secured upon a support bar 229 suspended between the main side frames 200 and 201. The angulation of the support arms are such that the undersurface of the belts 221 and 222 will engage the upper surface of the endless belt 214 between the belt drive roll 213 and the idler pulley 223. The contact between the belts serves to drive the pair of belts 221 and 222.

The vacuum roller 209 includes a plurality of vacuum cups 230 spaced around the circumference of the roll. The vacuum cups are spaced in three circumferential rows of eight cups in each row spaced 15 degrees apart from the cups in the adjacent row. All of the vacuum cups are connected through internal drillings in the vacuum roll to a vacuum manifold which, in turn, is connected to a vacuum pump as earlier described.

A vacuum plate is disposed beneath the under surface of the belt 214 at the point where the belt departs from the vacuum roll 209. The vacuum plate is supported in place by a pair of parallel support arms 232 which are carried upon a support shaft 233 anchored into the side frames of the separator. The support arms are biased in a direction to bring the vacuum plate into engagement with the belt.

The vacuum plate 231 includes a plurality of apertures in the upper surface thereof which connect to a vacuum manifold which, in turn, is connected to a vacuum pump. In a like manner, the surface of the belt 214 includes a plurality of apertures therein. As the belt passes over the vacuum plate, the vacuum induced through the apertures in the vacuum plate is, in turn, induced through the apertures in the belt 214.

In operation, an envelope to be opened will have already been deposited upn the floor plate 36. As the paddles continue to rotate, the leading weakened edge of the envelope will pass over the edge 234 of the floor plate 36 and drop between the belt 214 and the idler roller 218. The motion of the belt 214 will carry the envelope through the tortuous path toward the vacuum roller 209. A plurality of arcuate baffles at 235 are disposed between the idler rollers 218 and 220. These baffles serve to confine both panels of the envelope to the surface of the belt and to maintain the envelope within the tortuous path. As the envelope passes over the tortuous path, the reverse flexure of the panels over the envelope creates shearing forces along the edges thereof in a plane parallel to the edges and serves to crack or start opening of the preweakened edges. In other words, the preweakened edges of the envelope are further weakened but the shearing force is not great enough to achieve substantial relative displacement of the panels with respect to each other.

The envelopes, once having passed through the tortuous path for particle opening, are then passed between the belt and the vacuum roll 209. As the envelope reaches the vacuum roll, the suction cups in the roll will grip the top panel of the envelope. In a like manner, the bottom panel of the envelope will be gripped by the suction induced through the belt by the vacuum plate 231. As the envelope continues in the diverging path of the belt and the surface vacuum roll, the top panel thereof will be opened backwardly and the lower panel thereof maintained on the belt thus creating opposing opening forces perpendicular to the panels of the envelope. Continued motion of the belt will pull the envelope into engagement with a pair of rollers 237. These rollers serve as a nip roller to grip the edge of the envelope and continue to pull it and the contents along the belt 214 and into engagement with the second pair of belts 221 and 222. As this is occurring, the upper panel of the envelope comes ito engagement with a plurality of stripper fingers 236 positioned in annular grooves (not shown) in the vacuum roll 209. The stripper fingers serve to break the vacuum seal of the vacuum cups from the upper panel of the envelope thus permitting it to follow the first panel through the nip rollers.

As the envelope continues in its path of travel past the nip rollers 237, the contents and opened panels thereof will pass over the belt roll 213 between the belts. As this occurs, the panels and the contents of the envelope will be further ironed and flattened. A pair of stripper fingers 238 and 239 secured to the arms 227 and 228 further serve to insure the separation of the envelope and contents from the pair or belts 221 and 222. As this separation occurs, the opened envelope and contents will be deposited onto the conveyor 15 and delivered to the sorting desks.

XI. PADDLE CLEANERS — FIGS. 27 - 28

Figure 27:
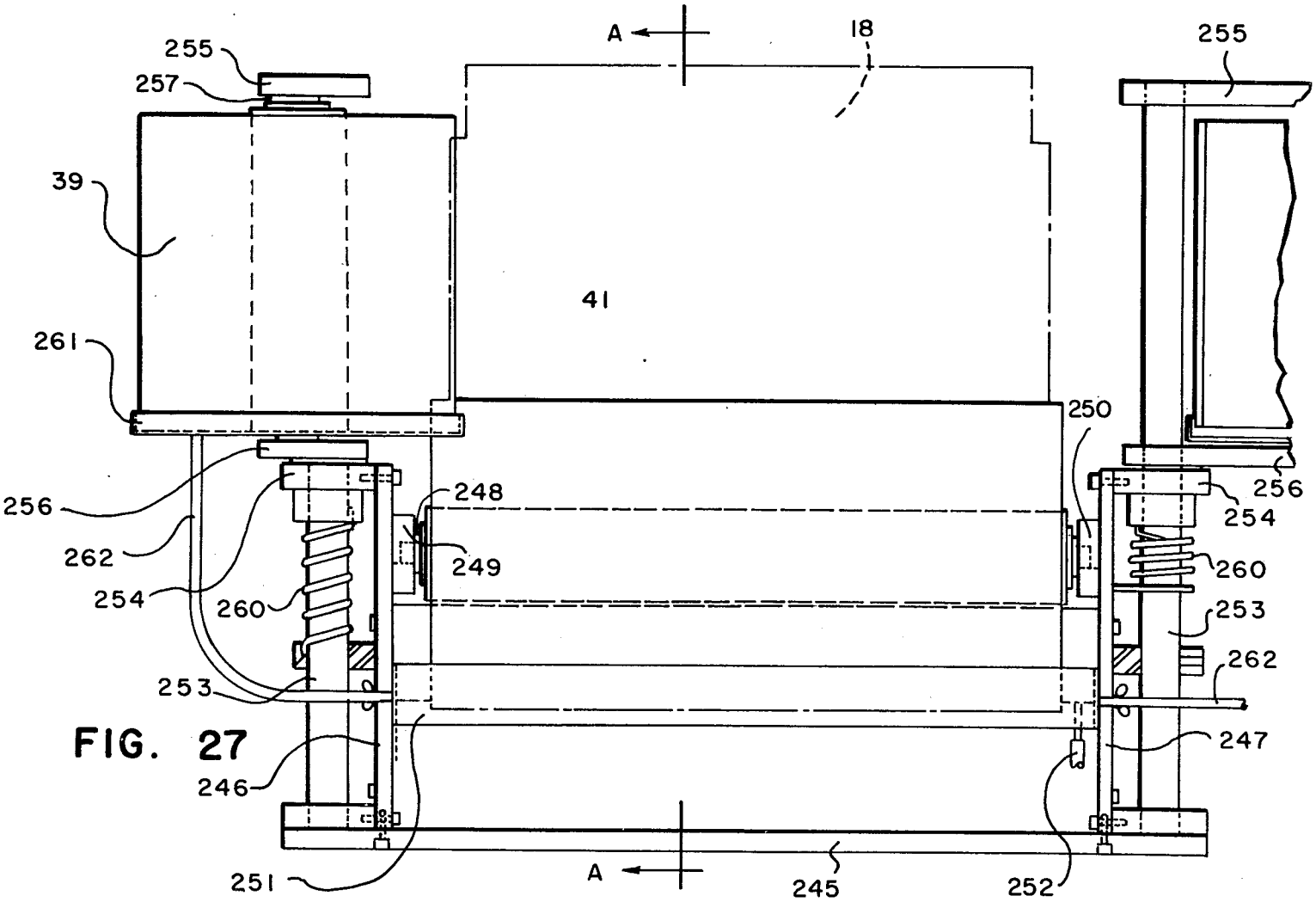
FIG. 27 is a side elevation view of the paddle wheel cleaning assembly of the present invention.
Figure 28:
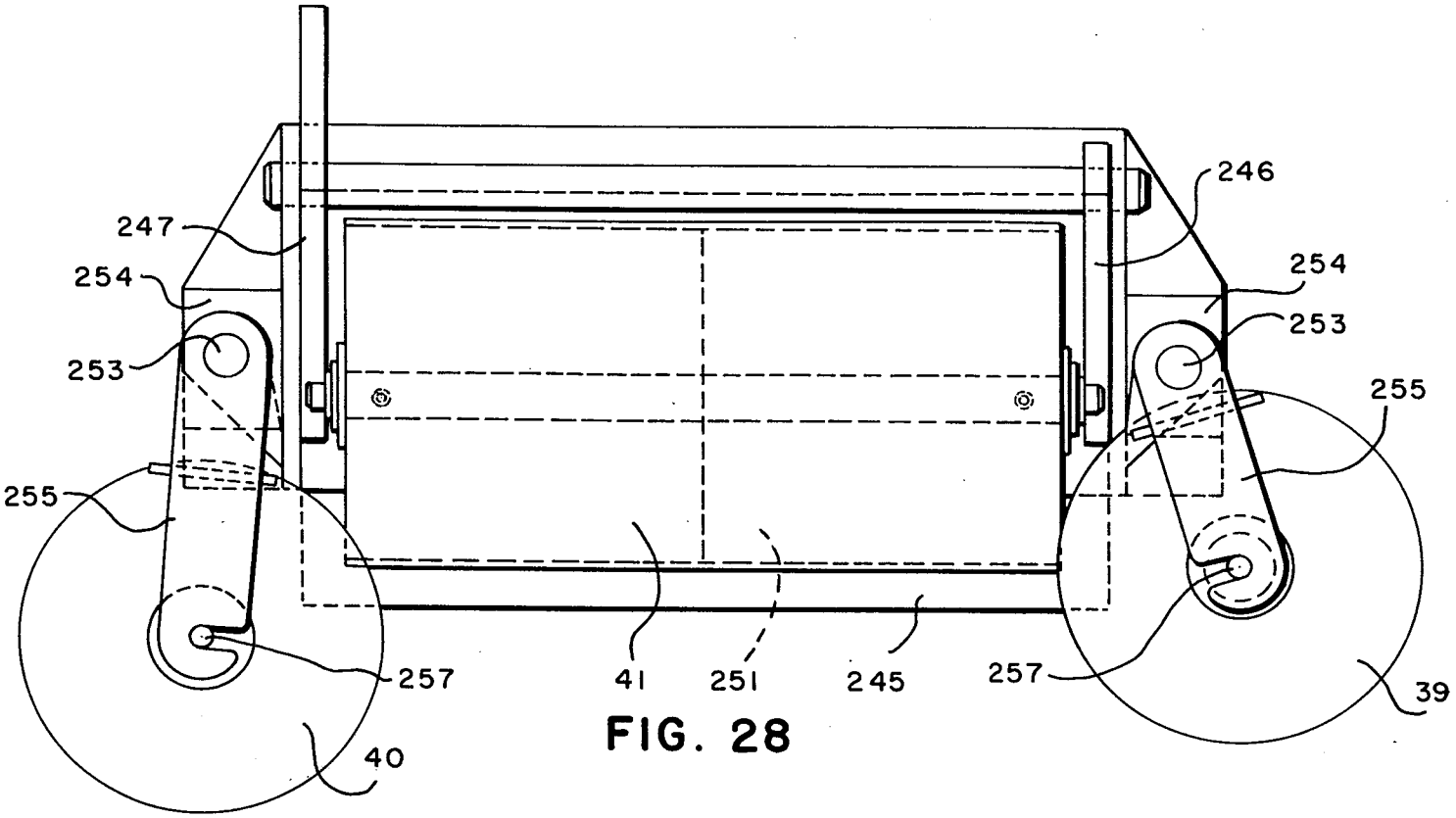
FIG. 28 is a plan view of the apparatus of FIG. 27.

The paddle cleaning assembly of the present invention is shown in FIGS. 27 and 28 of the drawings. This assembly includes a base plate 245 and a pair of side support plates 246 and 247 extending upwardly from the base plate.

The bottom edge cleaner 41 is carried upon a shaft 248 which is journaled at its either end into journals 249 and 250 secured to the side plates 246 and 247. The cleaning roller 41 is made of a sponge material and the positioning of the roll is such that the roll runs with a slight interference with the bottom edge of the paddles as they pass. The roll 41 is not driven but is rotated by the engagement of the paddles with the roll in their passage.

A drip pan 251 is positioned below the cleaning roller 41 and supported between the side walls supports 246 and 247. The height of the drip pan is such that the roll, as it rotates, will have a small part of its lower circumference emerged in the drip pan. A cleaning fluid is present in the drip pan and permeates the roller and effects the cleaning action upon the paddles as the roller rotates. A drain line 252 is provided in the bottom of the drip pan. The entrance end of the drain line is disposed above the bottom of the drip pan in order that a fluid level will be maintained in the drip pan.

The edge cleaning rollers 39 and 40 are of identical construction and are identically supported in the apparatus except that they are on opposite sides of the bottom edge cleaner 41. Accordingly, a description of one will suffice for both.

Each edge cleaning roller 39 and 40 are of a like sponge material. These rollers are supported upon vertical shafts 253 which are secured at their bottom into the base plate 245 and midway of their length into the side support walls by journals 254.

Each support shaft 253 provides the support for a pair of spaced parallel arms 255 and 256 in the upper end of the shaft. The arms 255 and 256 provide the support for the cleaning rollers 39 and 40 which are supported on shafts 257 which are, in turn secured to the arms in journals 258 and 259 of the upper and lower arms respectively.

Each shaft 253 employs a torsion spring 260 which urges the shafts and rollers supported thereby into engagement with the edges of the paddles. The torque of the springs is sufficient to assure that the soft sponge rollers press slightly into the edges of the paddles to insure sufficient penetration to clean any residue therein.

The cleaning fluid is delivered to both cleaning rollers 39 and 40 at their top portions by a fluid pump located in the bottom portion of the envelope opening apparatus. The cleaning fluid will gravitate downwardly through the rolls and into a drip pan 261. The drip pan 261 collects the cleaning fluid and it is drained from the drip pan into the lower drip pan 251 by means of drain tubes 262.

XII. CONTROL CIRCUITS — FIG. 29

Figure 29:
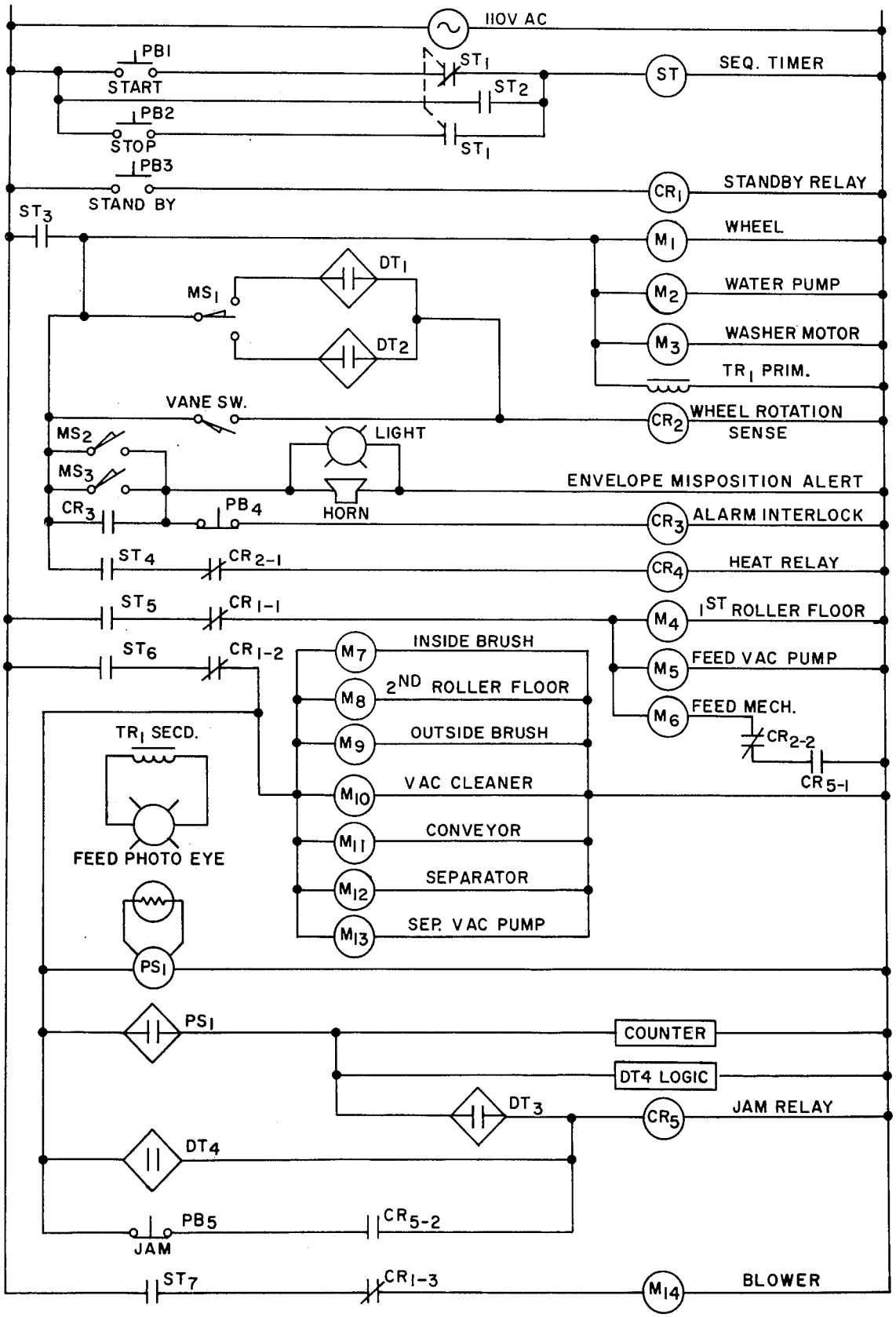
FIG. 29 is a circuit diagram of the control circuitry of the apparatus of the present invention.

The circuit diagram for the control circuitry for the envelope opening apparatus of the present invention is shown in FIG. 29 of the drawing. During start up, the start button PB1 is depressed which will energize sequenced timer ST through normally closed contacts ST1. The sequence timer immediately closes interlock contacts ST2 which permits the timer to remain energized. The timer has internal cams within the timer which will maintain the contacts ST2 closed thus retaining the interlock and energization of the timer for a period of 10 minutes at the end of which the timer comes to rest. During the 10 minute interval, the remaining timer contacts ST3 - ST7 are closed by camming means within the timer to effect a start up sequence as will be hereinafter described.

The sequence timer contacts ST3 close almost immediately upon the energization of the sequence timer and at the same time as contacts ST2. When the contacts ST3 close, the motor for driving the wheel, the water pump for the paddle washers and the washer motors are turned on. Additionally, the primary of transformer TR1 is energized to provide power to the feed photocell-light combination as will be hereinafter described.

The closing of contacts ST3 also provides a circuit to contacts ST4. The contacts ST4, in the start up phase, are closed immediately along with contacts ST2. Accordingly, a circuit is completed through contacts ST4 and normally closed relay CR 2-1 so that the heat relay CR4 is energized. Heat relay CR4 serves to turn on the power to the heaters thus starting their heat-up cycle.

Sequence time or contacts ST7 also close simultaneously with contacts ST2. Contacts ST7, upon closing, complete a circuit through blower motor M 14 to turn on the filtering and ventilation equipment within the housing of the envelope opening machine.

Provision is made to detect the failure of rotation of the wheel or of stoppage of the blower motor. Rotation of the wheel is sensed by means of microswitch MS1. The microswitch is positioned adjacent the paddles and is toggled by the continued passage of the paddles. The microswitch is a two contact microswitch and completes alternate circuits through two delay timers DT1 and DT2 which, in turn, are connected through relay CR2. The delay timers DT1 and DT2 have a time period greater than the normal toggle rate of the microswitch during the normal wheel rotation. If the wheel were to slow down or stop, the period between toggle reverses of the microswitch would exceed the time period of the delay timers and a circuit would be completed through one or the other of the delay timers to energize the relay CR2. Whenever relay CR2 is energized, relay contacts CR2-1 in series with the heat relay CR4 de-energizes the heat relay turning off the heat. Additionally, relay contacts CR2-2 in series with the feed mechanism also de-energize the feed mechanism if the same has reached the point in the cycle of being energized.

Operation of the blower is sensed by means of a vane switch which is also in series with the relay CR2. The vane switch is biased such that the blower static pressure maintains the vane open thus breaking the continuity of the circuit to the relay CR2. If the fan were to fail or slow down, the reduced static pressure would permit the vane switch to close thus energizing relay CR2 whcih would turn off the heat and the feed mechanism as above described.

Misposition of the envelope is also detected by the control circuit. This is accomplished by means of two microswitches MS2 and MS3 positioned on either side of the envelope and which are triggered if the envelop projects from the paddles a distance greater than is desired. If either one or both of the microswitches are closed, a circuit is completed through a light and horn which alerts the operator that a mispositioned envelope has been detected.

Once a mispositioned envelope is detected, a circuit is completed through the microswitches and normally closed push button PB4 through an alarm interlock relay CR3. When relay CR3 is energized, it closes interlock contacts CR3 thus maintaining the alarm circuit energized until it is de-energized by opening the interlock circuit by depressing push button PB4.

At this point in the start up cycle, the heaters safety circuits and wheel rotation have been started as well as other related functions above described. After a period of approximately 8 minutes, the sequence timer closes contacts ST5 and ST6. The closing of timer contacts ST5 energizes the motor M4 for the first roller floor M5 for the feed vacuum pump and M6 for the feed mechanism. Simultaneously, the closing of contacts ST6 energizes motors M7 through M13 which turn on the inside cleaning roller, the second roller floor, the outside cleaning roller, the vacuum cleaner motor for the envelope edges, the conveyor 15, the separator motor and, lastly, the separator vacuum pump.

Contacts ST6 also energize circuitry for detecting envelop jams in the feed track and either jams in the feed mechanism or depletion of envelopes in the feed mechanism. This is accomplished by means of a photocell and photoeye positioned in the exit end of the feed conveyor. The photocell light source is powered by the TR1 secondary earlier described. The light from the photo light is directed upon a photoeye which energizes photoswitch PS1.

Envelopes passing down the conveyor will block the light to the photoeye thus actuating the photoswitch PS1. Photoswitch PS1 includes contacts PS1 which are in series with a counter. The toggling of the contacts PS1 is registered in the counter and an accurate envelope count passing through the machine is maintained.

Additionally, the toggling of contacts PS1 is sensed by a logic circuit DT4. The logic circuit operates to sense the time from the last toggling of the photoswitch. If this time exceeds a predetermined time, for example where the envelopes have been depleted in the magazine or where the envelopes have jammed in the feed mechanism, then the logic circuit operates to close contacts DT4. When contacts DT4 close, a circuit is completed through the jam relay CR5 thus energizing the relay.

Relay CR5 includes a pair of contacts CR 5-1 in series with the feed mechanism motor M6. Relay contacts CR 5-1 are normally closed. When the relay CR5 is energized, these contacts open and discontinue further operation of the feed mechanism. Additionally jam relay CR5 includes contacts CR 5-2 in a series wih the jam relay CR5. When the relay contacts CT 5-2 close, a circuit is completed through normally closed jam push button PB5 to provide an interlock holding the jam relay closed until jam push button PB5 is manually opened.

Jams in the conveyor track are also detected by the jam detection circuit. Photoswitch contacts PS1 are also in series with a delay timer DT3. If an envelope jams in the conveyor track, the photoswitch contacts PS1 will be maintained closed. The delay timer DT3 has a timing period such that the normal toggling of the photoswitch contacts PS1 will not actuate the delay timer. However, if the contacts PS1 are maintained closed for a period of time beyond that normally expected in the passage of an envelope, delayed timer DT3 will be energized and thus jam relay CR5 will be energized. When this occurs, the feed mechanism and the interlock will operate as before described.

At this point in the timer sequence, all functions of the envelope opening machine are operable. The timer ST will time out after 10 minutes at which time contacts ST1 will be reversed such that the normally closed contacts ST1 in the start line will be opened and the contacts ST1 and the stop line will be closed. The contacts ST1, in this position, are ready for the initiation of the stop sequence upon the energization of the stop button PB2 as hereinafter described. Additionally, after the end of the 10 minute period, contacts ST2 open thus removing the interlock from the sequence timer stopping the timer. The sequence, at this point, is in the run condition and will continue indefinitely until the stop button or standby button is pushed.

The control sequence of the present invention provides for standby operation. In this condition, standby button PB3 is closed energizing standby relay CR1. Standby relay CR1 includes contacts CR 1-1 in series with motors M4 – M6 and contacts CR1-2 in series with motors M7 – M13 as may be seen from FIG. 29. When these contacts open, all of the operation of the envelope opening machine is discontinued except for the heat which is maintained on and the rotation of the wheel, water pump and washer motor. The machine will stay in the standby until the push button PB3 is opened. When this occurs, all of the supporting equipment again starts and the machine is in the run condition.

Shut down of the envelope opening machine is accomplished by depressing stop button PB2. When this occurs, a circuit is completed through now closed contacts ST1 to again start the sequence timer ST in its shut down sequence. The sequence timer, as in the start up procedure, immediately closes contacts ST2 to provide an interlock.

Sequence timer contacts ST4 and ST5 also immediately open upon start of the shut down sequence. As this occurs, the heat is turned off and the feed mechanism and its associated first roller floor and feed vacuum pump are turned off.

A delay period of approximately 2 minutes is then encountered after which sequence timer contacts ST6 open turning off motors M7 – M13 and their related equipment. This 2 minute delay is necessary inasmuch as envelopes just fed into a paddle pair will require a time of approximately 2 minutes to complete their rotation around the wheel and passage through the differential separator.

After the two minute time interval has passed the only equipment remaining running is the blower and the wheel and its related water pump and washer motor. This equipment is maintained in operation for a further 8 minute period. This is required to effect proper cool-down of the heaters and related equipment. Additionally, this provides further time to completely effect washing of all of the paddles within the machine.

After the full 10 minute interval has expired, the sequence timer reverses the condition of contacts ST1 to place the timer in condition for start. Additionally, timer contacts ST2 open thus discontinuing operation of the timer. In this condition, the cycle timer has returned to the ready position for start up.

We claim:

1. The method of opening envelopes comprising
   - conveying the envelopes edgewise on a first conveyor to a position between opposed protective paddles leaving the leading edge thereof slightly exposed;
   - closing the paddles to grip the envelope;
   - weakening the exposed leading edge;
   - opening the paddles above a second conveyor and conveying the envelopes to a position between the protective paddles to slightly expose the opposite edge and bottom edge thereof;
   - weakening the exposed opposite edge and bottom edge;
   - discharging the envelope from the protective paddles; and
   - applying opposed shearing forces to the side panels of the envelope following discharge thereof to separate the panels at the weakened edges thereof and expose the contents of the envelope.

2. The method of opening envelopes of claim 1 wherein the opposed forces applied are first a shearing force in a plane parallel to the panels of the envelope followed by tensile forces perpendicular to the panels.

3. Apparatus for opening an envelope having length and width and having three sides thereof weakened comprising,
   - envelope receiving means;
   - differential means for further weakening the said three weakened sides by creating opposing shearing forces upon the opposite panels of the envelope, said shearing forces being applied along the entire width of the envelopes in a plane generally parallel to the panels while preventing substantial relative displacement of said panels with respect to each other;
   - separating means for receiving the envelope from the differential means and applying opposite separating forces to the panels in a plane generally perpendicular to the panels; and
   - envelope discharging means.

4. The apparatus for opening envelopes of claim 3 wherein the separating means includes two opposed and diverging members through which a vacuum is created and between which the envelope passes in a direction of said divergence.

5. Apparatus for opening an envelope having three sides thereof weakened comprising,
   - receiving means for receiving the envelope;
   - an endless belt for conveying the envelope from the receiving means;
   - at least two idler rollers over which the belt and conveyed envelope pass to impart at least one reverse flexure of the envelope;
   - a vacuum drum in contact with the belt in the path of travel of the envelope and including apertures in the surface thereof through which a vacuum is drawn;
   - a vacuum plate in contact with the belt on the opposite side thereof from the vacuum drum and including apertures therein through which a vacuum is drawn;
   - a plurality of apertures through the belt through which the vacuum plate draws a vacuum; and
   - means for discharging the envelope whereby the reverse flexure over the idler rollers will crack the envelope edges and the vacuum drum will lift the top panel from the bottom panel which is held upon the belt by the vacuum plate.

6. The apparatus for opening envelopes of claim 5 further including an annular groove in the vacuum drum; and
   - stripper fingers positioned within the groove to strip the top panel of the envelope from the vacuum drum in its path of travel through the apparatus.

7. The envelope opening apparatus of claim 5 further including a nip roller running in engagement with the belt following the vacuum drum for engaging the lower panel and contents of the envelope following separation to insure passage thereof through the apparatus.

8. The apparatus of claim 5 further including a pressure roller running in engagement with the belt at a position following the vacuum drum for exerting a pressure upon the open envelope and its contents to flatten the envelope and contents.

9. The envelope opening apparatus of claim 5 wherein the means for discharging the envelope includes a second endless belt running partially in engagement with the first endless belt at a point following the envelope's path of travel passed the vacuum drum.

10. The method of opening an envelope having length and width and having three sides thereof weakened comprising, first further weakening the said three weakened sides by exerting opposing shearing forces to the panels of the envelope, said shearing forces being applied along the entire width of the envelopes in a plane generally parallel to the panels while preventing substantial relative displacement of said panels with respect to each other; and secondly applying opposing separating forces generally perpendicular to the panels to separate them and expose the contents.

11. The method of opening an envelope of claim 10 wherein the separating forces are created by passing the envelope between two diverging members through which a vacuum is pulled upon the panels.

12. The method of opening an envelope of claim 10 further including the step of inducing a flexure reversal upon the envelope and contents following separation thereof and in a direction to flatten the opened panels and contents.

13. Apparatus for opening an envelope having three sides thereof weakened comprising:

envelope receiving means;

differential means including means which convey the envelope over a tortious path to flex the panels of the envelope thereby creating opposing shearing forces upon the opposite panels of the envelope in a plane generally parallel to the panels;

separating means for receiving the envelope from the differential means and applying opposite separating forces to the panels in a plane generally perpendicular to the panels; and envelope discharging means.

14. The method of opening an envelope having three sides thereof weakened comprising:

first exerting opposing shearing forces to the panels of the envelope in a plane generally parallel to the panels by passing the envelope over a tortious path to create at least flexure reversal of the panels of the envelope; and secondly applying opposing separating forces generally perpendicular to the panels to separate them and expose the contents.

* * * * *